US007499010B2

(12) United States Patent
Mizumaki

(10) Patent No.: US 7,499,010 B2
(45) Date of Patent: Mar. 3, 2009

(54) DISPLAY, DRIVER DEVICE FOR SAME, AND DISPLAY METHOD FOR SAME

(75) Inventor: Hidetaka Mizumaki, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 674 days.

(21) Appl. No.: 10/937,373

(22) Filed: Sep. 10, 2004

(65) Prior Publication Data

US 2005/0068282 A1 Mar. 31, 2005

(30) Foreign Application Priority Data

Sep. 29, 2003 (JP) ..... 2003-337699
Jun. 11, 2004 (JP) ..... 2004-174610

(51) Int. Cl.
*G09G 3/36* (2006.01)

(52) U.S. Cl. ..... 345/89; 345/88; 345/98; 345/204; 345/690

(58) Field of Classification Search ..... 345/89, 345/88, 98, 204, 690
See application file for complete search history.

(56) References Cited

U.S. PATENT DOCUMENTS 6,396,469 B1 5/2002 Miwa et al.
7,034,786 B2 * 4/2006 Ham ..... 345/88

* cited by examiner

*Primary Examiner*—Richard Hjerpe
*Assistant Examiner*—Leonid Shapiro
(74) *Attorney, Agent, or Firm*—Nixon & Vanderhye P.C.

(57) ABSTRACT

There is provided a data signal line drive circuit which, when displaying a video signal composed of multiple display frames, drives in at least one of the display frames so as to produce a less-than-grayscale-level display frame where a data signal fed to the data signal lines contains a signal less than a grayscale level represented by the video signal. Thus, a data-hold-type display, a driver device for the display, a display method for the display are provided which is capable of preventing display quality degradation due to afterimages observable in moving image displays without reducing screen brightness.

28 Claims, 13 Drawing Sheets

DISPLAY, DRIVER DEVICE FOR SAME, AND DISPLAY METHOD FOR SAME

This Nonprovisional application claims priority under 35 U.S.C. § 119(a) on Patent Application Nos. 2003-337699 and 2004-174610 filed in Japan on Sep. 29, 2003 and Jun. 11, 2004, respectively the entire contents of which are hereby incorporated by reference.

FIELD OF THE INVENTION

The present invention relates to displays based on hold-type display elements, driver devices for such displays, and display methods for such displays, and especially to technology which improves moving image capabilities of displays based on a matrix array of display elements.

BACKGROUND OF THE INVENTION

Most conventional television and other display devices are built around CRTs (cathode ray tubes). The CRT is however being replaced by liquid crystal displays, particularly those of matrix types, due to the latter's recent improvements in viewing angle, contrast, and color reproduction, as well as for their small dimensions and power saving features.

A matrix liquid crystal display includes: a set of scan signal lines in the display area; a scan signal line drive circuit (gate driver) supplying the scan signal lines with scan signals; a set of data signal lines positioned to cross the set of scan signal lines at right angles; a data signal line drive circuit (data driver) supplying data signals to the data signal lines in accordance with display signals; a control circuit (controller) controlling the scan signal line drive circuit and the data signal line drive circuit; and switching TFTs (thin film transistors) located where the scan signal lines cross the data signal lines for pixel controlling purposes. The data signals are applied to pixel electrodes connected to those TFTs selected by the scan signals, to control the alignment of liquid crystal in the pixels by means of the potential difference from the opposite electrode.

Liquid crystal provides a capacitive load and is therefore, when a data signal voltage is applied to the pixel electrode, aligned and held in that state in accordance with the applied data signal voltage. Thus, liquid crystal is said to have a "hold" property. The liquid crystal produces a flicker-free display when compared to the CRT. The liquid crystal, however, develops afterimages and other degradation in quality in movies due to its slow response speed. The response speed is especially slow when effecting grayscale, because the liquid crystal does not respond sufficiently in one frame period of a video input signal.

The liquid crystal has other problems too. When a TFT is deselected, the data signal written to a corresponding pixel is held. Therefore, for example, even with a liquid crystal with improved response speed, afterimages persist on the retina because the observer's eye tracks the moving image.

Addressing these problems is, among others, Japanese unexamined patent application 11-109921/1999 (Tokukaihei 11-109921; published on Apr. 23, 1999) disclosing s liquid crystal display method. A US patent is granted on an equivalent to the Japanese application (U.S. Pat. No. 6,396,469 issued on May 28, 2002).

According to the liquid crystal display method disclosed in the Japanese application, the screen is horizontally divided into two portions: a pixel array 101*a* and a pixel array 101*b* (see FIG. 12). In the first half of a frame period, the upper portion of the screen is scanned with data signals, and the lower portion of the screen is scanned with black (blank) signals at the same time. In the latter half of the frame period, the upper portion of the screen is scanned with black (blank) signals, and the lower portion of the screen is scanned with data signals.

According to the liquid crystal display method, each pixel goes through both an image display period and a black display period in a frame period. See FIG. 13. The very presence of the black display period enables an image display with two successive frame data sets being clearly separated. The separation improves display performance in relation to afterimages in movies.

However, this conventional liquid crystal display method suffers from poor brightness across the display screen, because either the upper or lower portion of the screen is always producing a black display.

Specifically, each frame period is divided into the first and second halves. The screen is also divided horizontally into two portions. Further, in the first half of the frame period, the upper portion of the screen is scanned with data signals, and the lower portion of the screen is scanned with black (blank) signals at the same time. In the latter half of the frame period, the upper portion of the screen is scanned with black (blank) signals, and the lower portion of the screen is scanned with data signals.

SUMMARY OF THE INVENTION

The present invention has an objective to offer a display capable of preventing display quality degradation due to afterimages in moving image displays without causing brightness reduction on the screen, a driver device for such a display, and a display method for such a display.

A display in accordance with the present invention, to achieve the objective, includes:

scan signal lines:

data signal lines fed with a video signal as a data signal;

a display section in which pixels are arranged to form a matrix, the pixels being connected via switching sections correspondingly to intersections of the scan signal lines and the data signal lines; and first drive means, when displaying a video signal composed of multiple display frames, driving in at least one of the display frames so as to produce a less-than-grayscale-level display frame where a data signal fed to the data signal lines contains a signal less than a grayscale level represented by the video signal, wherein the signal less than the grayscale level is associated with a signal level in a preceding display frame.

A driver device for a display in accordance with the present invention, to achieve the objective, is a driver device for a display including: scan signal lines; data signal lines fed with a video signal as a data signal; and a display section in which pixels are arranged to form a matrix, the pixels being connected via switching sections correspondingly to intersections of the scan signal lines and the data signal lines.

The driver device includes first drive means, when displaying a video signal composed of multiple display frames, driving in at least one of the display frames so as to produce a less-than-grayscale-level display frame where a data signal fed to the data signal lines contains a signal less than a grayscale level represented by the video signal, wherein the signal less than the grayscale level is associated with a signal level in a preceding display frame.

A display method for a display in accordance with the present invention, to achieve the objective, is a display method for a display including: scan signal lines; data signal lines fed with a video signal as a data signal; and a display section in which pixels are arranged to form a matrix, the pixels being connected via switching sections correspondingly to intersections of the scan signal lines and the data signal lines, The method includes the step of, when displaying a video signal composed of multiple display frames, displaying in at least one of the display frames so as to produce a less-than-grayscale-level display frame where a data signal fed to the data signal lines contains a signal less than a grayscale level represented by the video signal, wherein in the step, the signal less than the grayscale level is associated with a signal level in a preceding display frame.

According to the display, driver device, and display method for a display in accordance with the present invention, the first drive means, when displaying a video signal composed of multiple display frames, drives and displays in at least one of the display frames so as to produce a less-than-grayscale-level display frame where a data signal fed to the data signal lines contains a signal less than a grayscale level represented by the video signal.

In other words, liquid crystal displays and like displays have a data-hold property whereby when a data signal voltage is applied to a pixel electrode, an alignment state resulting from a change in accordance with the applied data signal voltage is held. Thus, afterimages occur when displaying moving images, causing display quality degradation.

The issue is addressed by the present invention: At least one of the display frames is a less-than-grayscale-level display frame where a signal output level to an original data signal line is lower than a grayscale level display frame which is a level equal to or greater than the grayscale level represented by the video signal. The less-than-grayscale-level signal is associated with a signal level in a preceding display frame.

Therefore, external control enables displays based on data-hold-type elements to produce displays like those on level-decay-type CRTs.

In addition, according to the present invention, since it is not that either the upper portion of the screen or the lower portion of the screen always produces a black display, overall brightness across the entire display screen does not fall.

Therefore, a display, its driver device, and a display method for the display can be provided which is capable of preventing display quality degradation due to afterimages observable in moving image displays without reducing screen brightness.

Another display in accordance with the present invention, to achieve the objective, includes:

scan signal lines;

data signal lines fed with a video signal as a data signal;

a display section in which pixels are arranged to form a matrix, the pixels being connected via switching sections correspondingly to intersections of the scan signal lines and the data signal lines;

storage means storing video signal data for at least one display frame in a video signal composed of multiple display frames; and second drive means (i) causing n outputs of the video signal data for one display frame stored in the storage means at n-times speed (n is an integer greater than or equal to 2) in one vertical period and (ii) driving in at least one of the n n-time speed display frames so as to produce a less-than-grayscale-level display frame where a data signal fed to the data signal lines contains a signal less than a grayscale level represented by the video signal, wherein the signal less than the grayscale level is associated with a signal level in a preceding display frame.

Another driver device for a display in accordance with the present invention, to achieve the objective, is a driver device for a display including: scan signal lines; data signal lines fed with a video signal as a data signal; and a display section in which pixels are arranged to form a matrix, the pixels being connected via switching sections correspondingly to intersections of the scan signal lines and the data signal lines.

The driver device includes:

storage means storing video signal data for at least one display frame in a video signal composed of multiple display frames; and second drive means (i) causing n outputs of the video signal data for one display frame stored in the storage means at n-times speed (n is an integer greater than or equal to 2) in one vertical period and (ii) driving in at least one of the n n-time speed display frames so as to produce a less-than-grayscale-level display frame where a data signal fed to the data signal lines contains a signal less than a grayscale level represented by the video signal, wherein the signal less than the grayscale level is associated with a signal level in a preceding display frame.

Another display method for a display in accordance with the present invention, to achieve the objective, is a display method for a display including: scan signal lines; data signal lines fed with a video signal as a data signal; and a display section in which pixels are arranged to form a matrix, the pixels being connected via switching sections correspondingly to intersections of the scan signal lines and the data signal lines, The method includes the steps of:

storing video signal data for at least one display frame in a video signal composed of multiple display frames; and causing n outputs of the stored video signal data for one display frame at n-times speed (n is an integer greater than or equal to 2) in one vertical period and displaying in at least one of the n n-time speed display frames so as to produce a less-than-grayscale-level display frame where a data signal fed to the data signal lines contains a signal less than a grayscale level represented by the video signal, wherein in the steps, the signal less than the grayscale level is associated with a signal level in a preceding display frame.

In a display controlled at timings of the invention, there is a need to apply to pixels after causing a decay as a less-than-grayscale-level display frame; therefore, unless the video signal frame rate is sufficiently high, the less-than-grayscale-level display frame appears flickering in some cases.

Accordingly, with the display, its driver device, and the display method for a display in accordance with the present invention, first of all, video signal data for at least one display frame in a video signal composed of multiple display frames is stored in the storage means. The stored video signal data for one display frame is then output n times at n-times speed (n is an integer greater than or equal to 2) in one vertical period. Here, at least one of the n n-time speed display frames is driven and displayed so as to produce a less-than-grayscale-level display frame where a data signal fed to the data signal lines contains a signal less than a grayscale level represented by the video signal. The signal less than the grayscale level is associated with a signal level in a preceding display frame.

Therefore, through control at such timings, the video signal is temporarily converted to n-times speed. One of the two is treated as a grayscale level display frame, and the other as a less-than-grayscale-level display frame. As a result, there is no decrease in frame rate when compared to the original video signal. Thus, no flickers occur.

This ensures that a display, its driver device, and a display method for such a display is provided which is capable of preventing display quality degradation due to afterimages observable in moving image displays without reducing screen brightness.

Another display in accordance with the present invention, to achieve the objective, includes:

scan signal lines:

data signal lines fed with a video signal as a data signal;

a display section in which pixels are arranged to form a matrix, the pixels being connected via switching sections correspondingly to intersections of the scan signal lines and the data signal lines; and third drive means, when displaying a video signal composed of multiple display frames, driving, in at least one of the display frames, a mixture of a grayscale level display where a data signal fed to the data signal lines represents the video signal and a less-than-grayscale-level display where the data signal fed to the data signal lines contains a signal less than a grayscale level represented by the video signal, by shifting an output timing, wherein the signal less than the grayscale level is associated with a signal level in a preceding display frame.

Another driver device for a display in accordance with the present invention, to achieve the objective, is a driver device for a display including: scan signal lines; data signal lines fed with a video signal as a data signal; and a display section in which pixels are arranged to form a matrix, the pixels being connected via switching sections correspondingly to intersections of the scan signal lines and the data signal lines.

The driver device includes: third drive means, when displaying a video signal composed of multiple display frames, driving, in at least one of the display frames, a mixture of a grayscale level display where a data signal fed to the data signal lines represents the video signal and a less-than-grayscale-level display where the data signal fed to the data signal lines contains a signal less than a grayscale level represented by the video signal, by shifting an output timing, wherein the signal less than the grayscale level is associated with a signal level in a preceding display frame.

Another display method for a display in accordance with the present invention, to achieve the objective, is a display method for a display including: scan signal lines; data signal lines fed with a video signal as a data signal; and a display section in which pixels are arranged to form a matrix, the pixels being connected via switching sections correspondingly to intersections of the scan signal lines and the data signal lines.

The method includes the step of, when displaying a video signal composed of multiple display frames, driving, in at least one of the display frames, a mixture of a grayscale level display where a data signal fed to the data signal lines represents the video signal and a less-than-grayscale-level display where the data signal fed to the data signal lines contains a signal less than a grayscale level represented by the video signal, by shifting an output timing, wherein in the step, the signal less than the grayscale level is associated with a signal level in a preceding display frame.

According to the foregoing invention, a switching is done between full pixel charging and imperfect pixel charging for each frame. Alternatively, full charging and imperfect charging can coexist in one frame.

Accordingly, in the present invention, the third drive means drives, in one display frame, a mixture of a grayscale level display where a data signal fed to the data signal lines represents the video signal and a less-than-grayscale-level display where the data signal fed to the data signal lines contains a signal less than a grayscale level represented by the video signal, by shifting an output timing. The signal less than the grayscale level is associated with a signal level in a preceding display frame.

This provides a display, its driver device, and a display method for such a display which is capable of preventing display quality degradation due to afterimages observable in moving image displays without reducing screen brightness in one display frame.

Additional objects, advantages and novel features of the invention will be set forth in part in the description which follows, and in part will become apparent to those skilled in the art upon examination of the following or may be learned by practice of the invention.

BRIEF DESCRIPTION OF THE DRAWINGS

FIG. 2(*b*) is a block diagram showing the arrangement of a data signal line drive circuit.

DESCRIPTION OF THE EMBODIMENTS

Embodiment 1

The following will describe an embodiment of the present invention in reference to FIG. 1 through FIG. 8. The description of the present embodiment will focus on a liquid crystal display as the display in accordance with the present invention; however, the invention is applicable to any display of data hold type, and thus not limited to liquid crystal displays. The arrangements in the figures are meant only to explain embodiments of the present invention. The present invention is not represented only by the arrangements described here.

Figure 2:
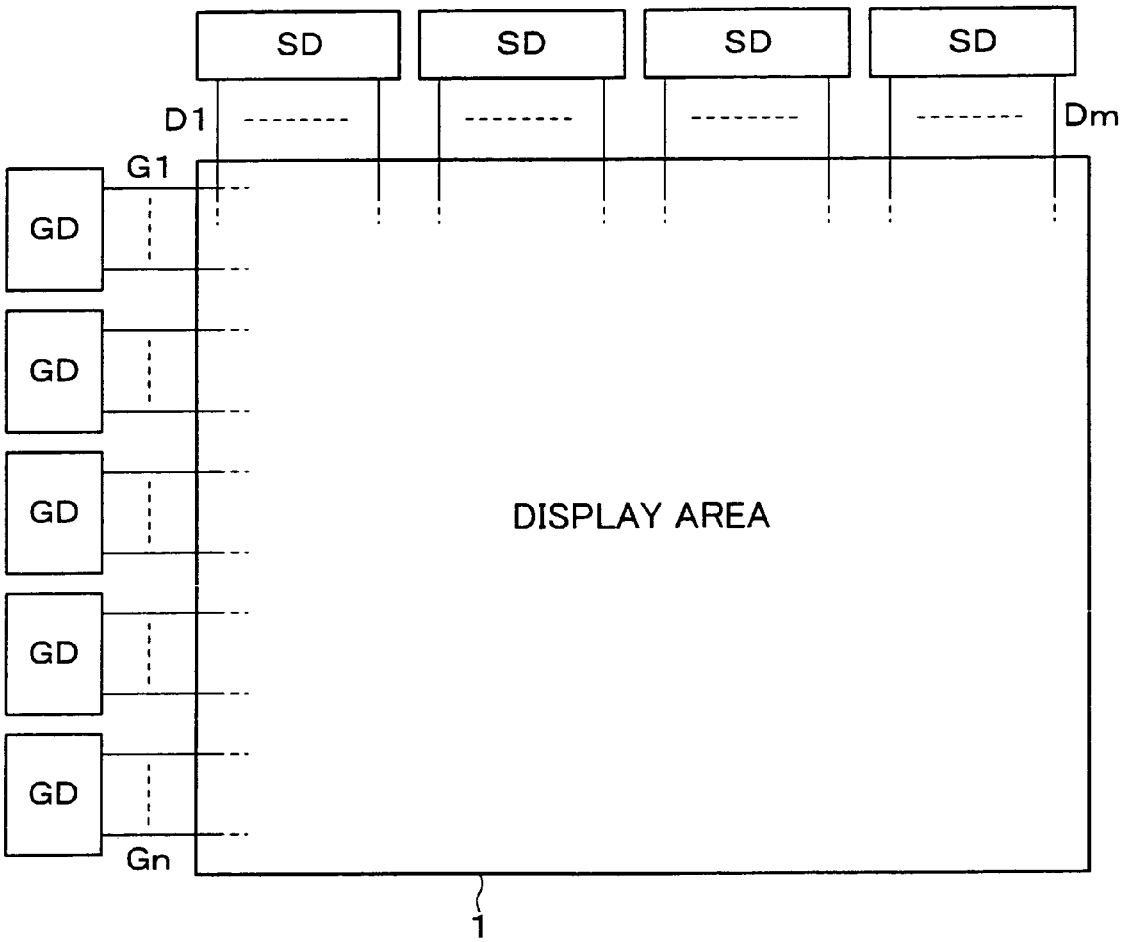
FIG. 2(*a*) is a front view schematically showing the arrangement of the liquid crystal display.
Figure 2:
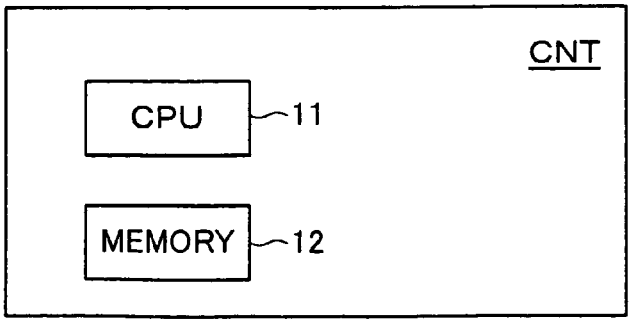

An active matrix liquid crystal display of the present embodiment includes, as shown in FIG. 2(*a*), a display area 1 as a display section; a set of scan signal lines G; scan signal line drive circuits (gate drivers) GD as display driver devices supplying scan signals to the scan signal lines G; a set of data signal lines D positioned to cross the set of scan signal lines G at substantially right angles; and data signal line drive circuits (data drivers) SD as a display driver device and first drive means supplying data signals corresponding to the display signals to the data signal lines D. In addition, a control circuit CNT supplying control and other signals to the scan signal line drive circuits (gate drivers) GD and the data signal line drive circuits SD is, as shown in FIG. 2(*b*), provided with a CPU 11 as determining means and a memory 12 as storage means.

The present embodiment involves n scan signal lines G and m data signal lines D. Five scan signal line drive circuits (gate drivers) GD are assigned driving the n scan signal lines G, and four data signal line drive circuits (data drivers) SD are assigned driving the m data signal lines D.

Figure 3:
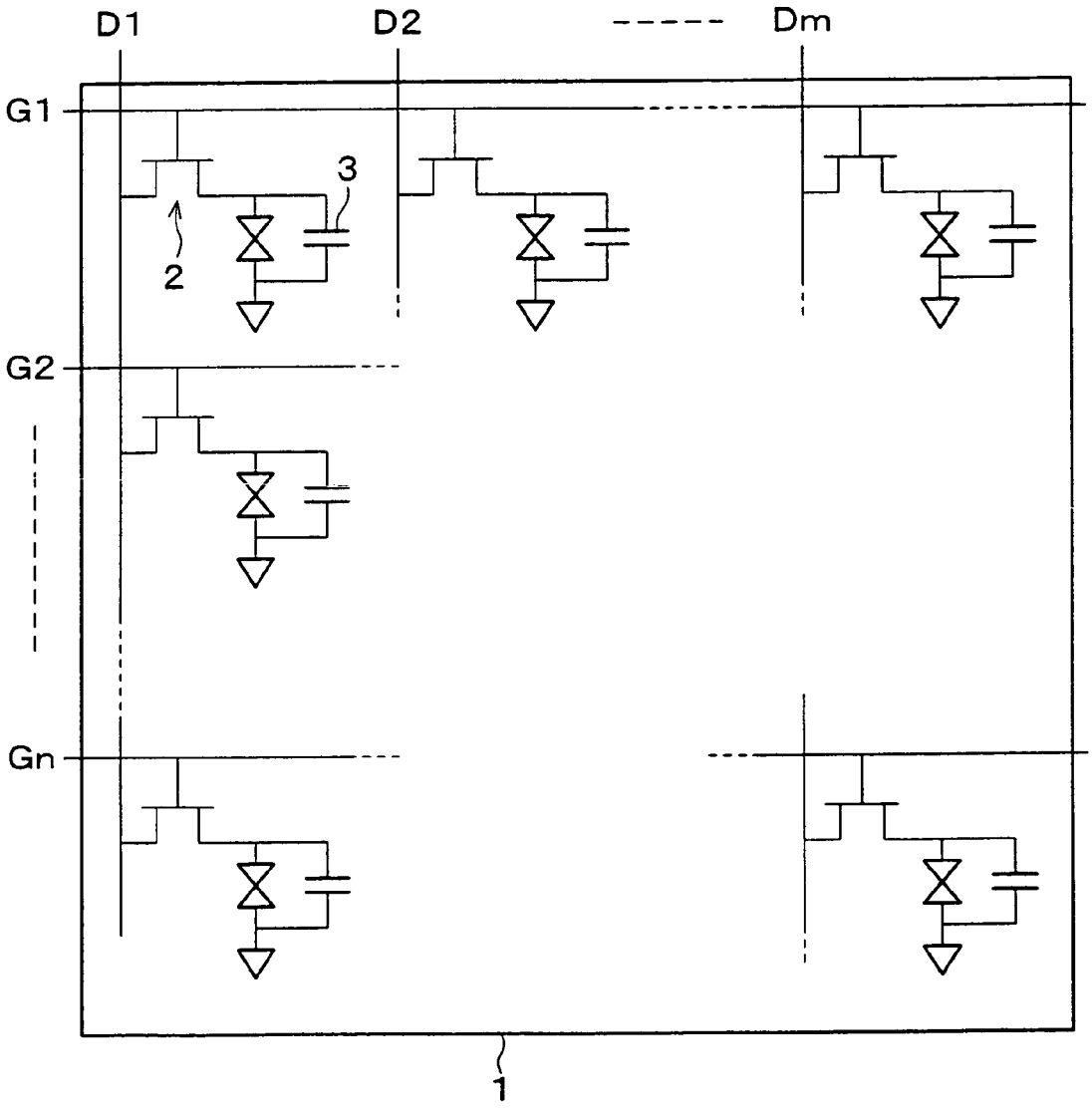
FIG. 3 is a front view showing the display area of the liquid crystal display.

As shown in FIG. 3, the scan signal lines G are connected to the gates of TFTs (thin film transistors) 2 each provided to a different pixel in the display area 1. The data signal line D are similarly connected to the sources of the TFTs 2. When a scan signal line G is active, those TFTs 2 connected to that line G acquire data signals to the pixel electrodes 3 from the data signal lines D. When the scan signal line G is inactive, the TFTs 2 hold the charge applied to the pixel electrodes 3 connected to the TFTs 2, that is, hold data.

Figure 1:
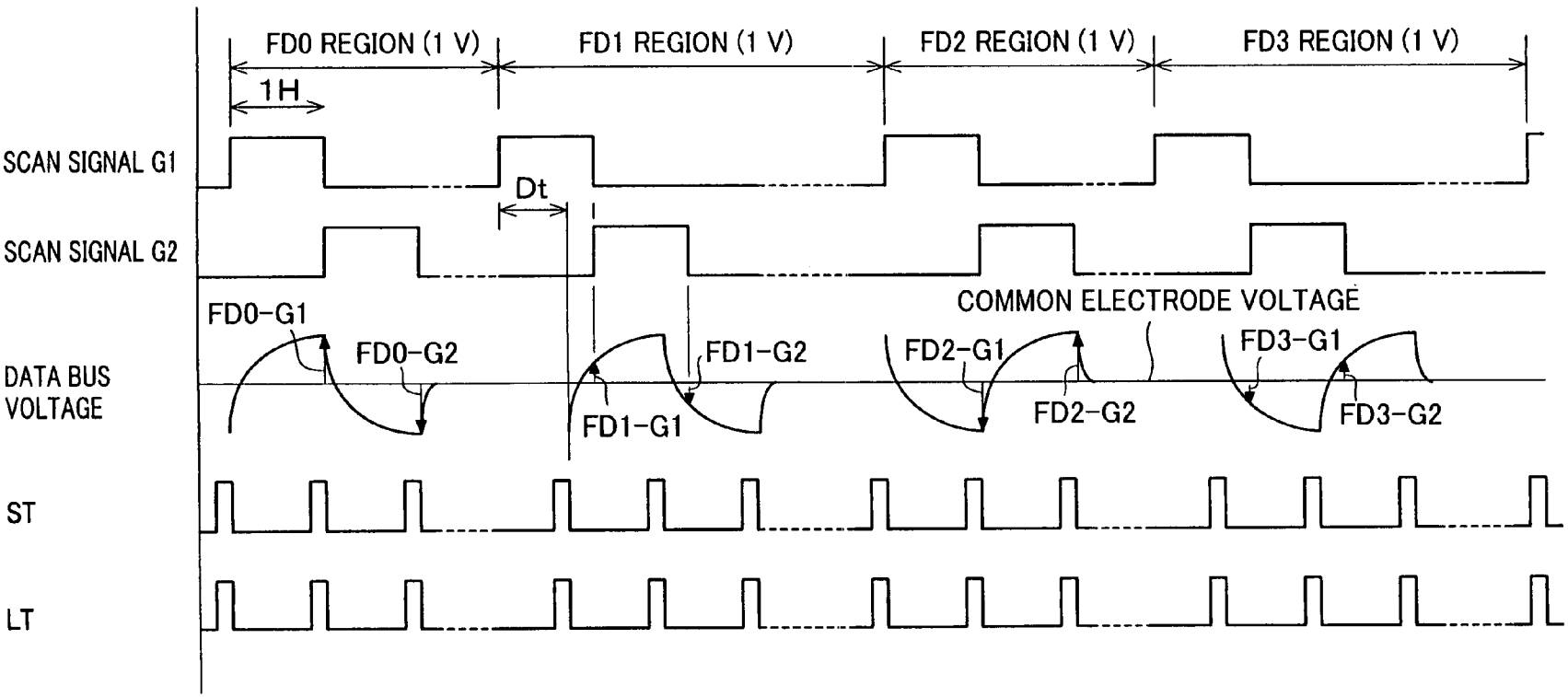
FIG. 1 is a timing chart showing major drive signals in details for an embodiment of a liquid crystal display in accordance with the present invention.

Next, major drive signals for the liquid crystal display will be described in reference to FIG. 4 and FIG. 1.

Figure 4:
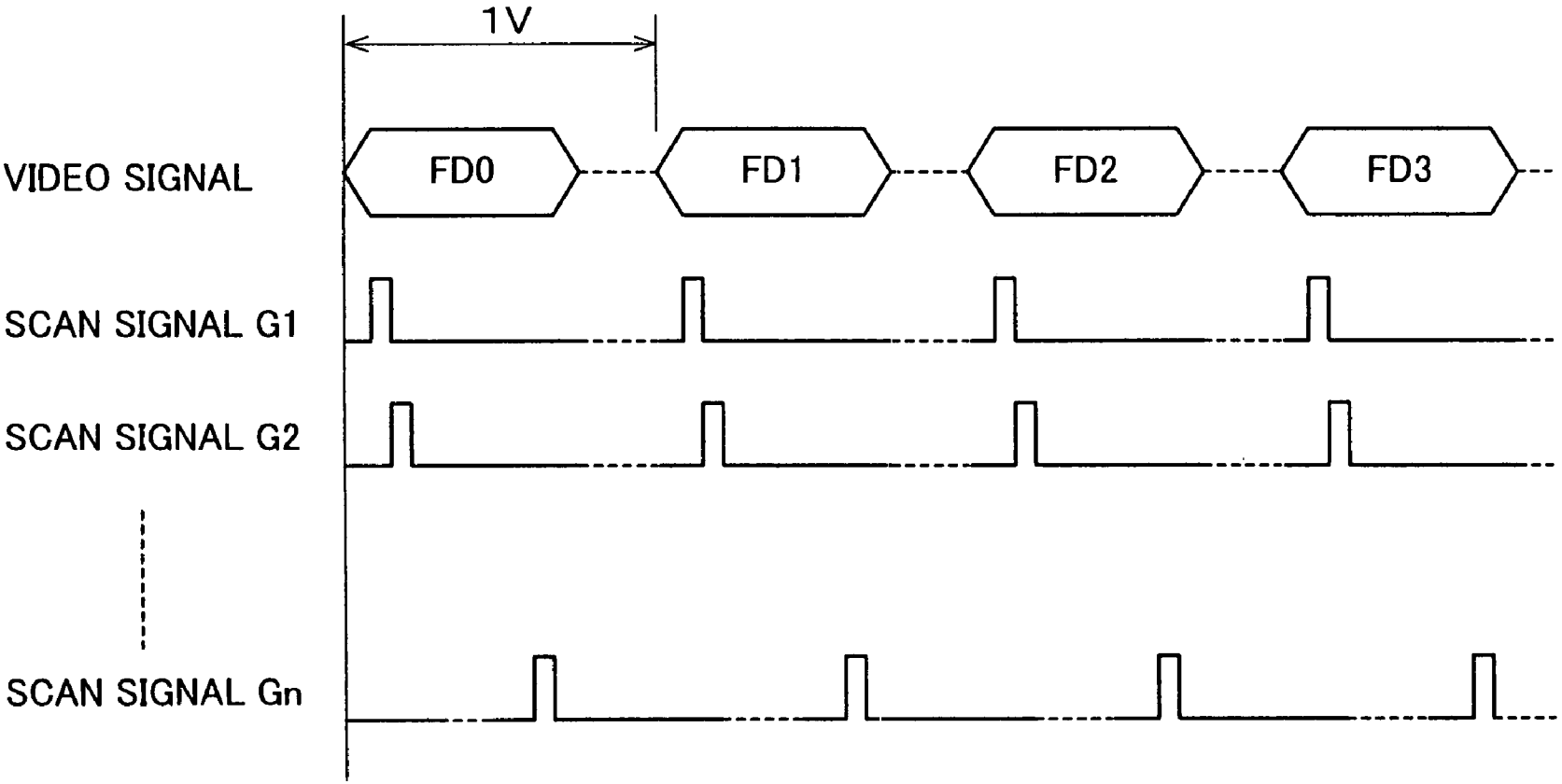
FIG. 4 is a timing chart schematically showing major drive signals for the liquid crystal display.

Referring to FIG. 4, video signals FD are fed to the liquid crystal display on each vertical synchronization (1 V) in the order of FD0, FD1, FD2, FD3 . . . If, for example, the liquid crystal display is driven at the same timings as the video signal is fed, the video signal may be used as the data signal for the data signal line D. The present embodiment assumes, for the sake of convenience, that the timings are matched.

In contrast, the scan signals G1 to Gn are sequentially output in agreement with the input timings of video signals. FIG. 1 shows signals for a particular one of the pixels under the foregoing circumstances. In the figure, the data bus voltage refers to the voltage input to the data signal line D. Also, ST refers to start pulses which control the input timings of video signals in the data signal line drive circuit SD. LT refers to latch pulses which control the output timings of data signals from the data signal line drive circuit SD to the data signal line D. Note that the start pulses ST and the latch pulses LT are used for different purposes and do not necessarily occur completely at the same timings, although so illustrated in the figure.

Now, paying attention to the phase relationship between the scan signals G1, G2 and the latch pulses LT in the figure, the relationship shows a slight timing difference Dt between the case of the video signal FD0 region and the video signal FD2 region and the case of the video signal FD1 region and the video signal FD3 region. Specifically, it would be understood that in the present embodiment, the phase of the latch pulse LT is delayed relatively to the scan signals G1, G2 in the case of the video signal FD1 region and the video signal FD3 region. That is, two kinds of frames appear alternately with respect to the video signals FD in the frames; in one kind of the frames, the latch pulse LT is turned on simultaneously with a rise of the scan signal G1, and in the other, the latch pulse LT is turned on when a difference Dt has elapsed after a rise of the scan signal G1.

By so doing, the application voltage (charge) to the TFT pixel is varied from the start of the charging to the data signal line D (data bus). In other words, no charging is done at all to the pixel in the video signal FD1 region and the video signal FD3 region.

By deliberately controlling the charging of the data signal line D without externally manipulating the video signal in this manner, some pixels (FD0-G1, FD0-G2, FD2-G1, FD2-G2) are fully charged, and the others (FD1-G1, FD1-G2, FD3-G1, FD3-G2) are imperfectly charged. Operation is switched between the two groups of pixels to drive data-hold-type displays like the liquid crystal display in a similar manner to the CRT (cathode ray tube). The foregoing description assumed that full charging took place in the video signal FD0 region and the video signal FD2 region and that imperfect charging took place in the video signal FD1 region and the video signal FD3 region, that is, a full charge frame and an imperfectly charged frame recurred alternately. This is not the only possible method. However, it is considered more effective in terms of ensuring responsivity and brightness if those pixels in a frame immediately before imperfectly charged pixels are fully charged pixels.

Figure 5:
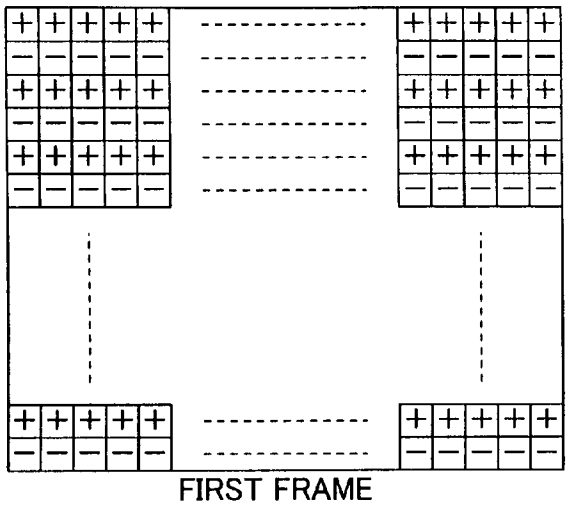
FIG. 5(*a*) to FIG. 5(*d*) are front views showing the display area of the liquid crystal display in polarity-reversal drive (line-reversal drive).
Figure 5:
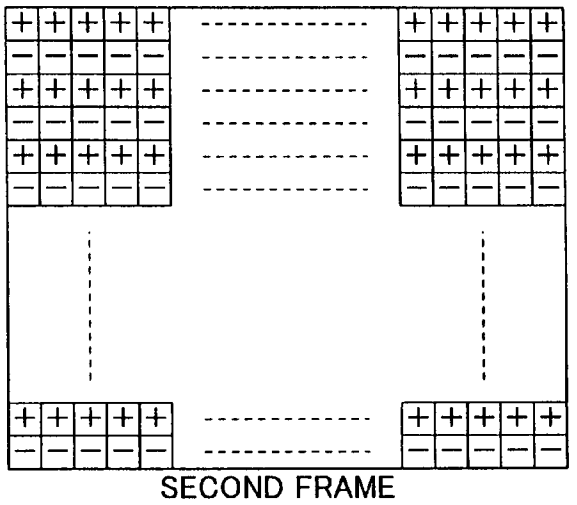
Figure 5:
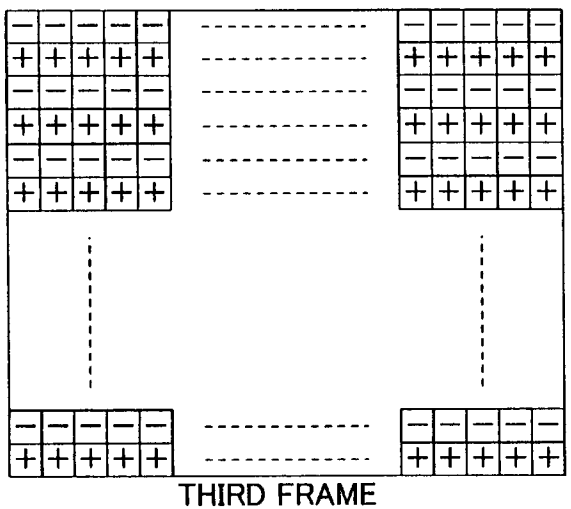
Figure 5:
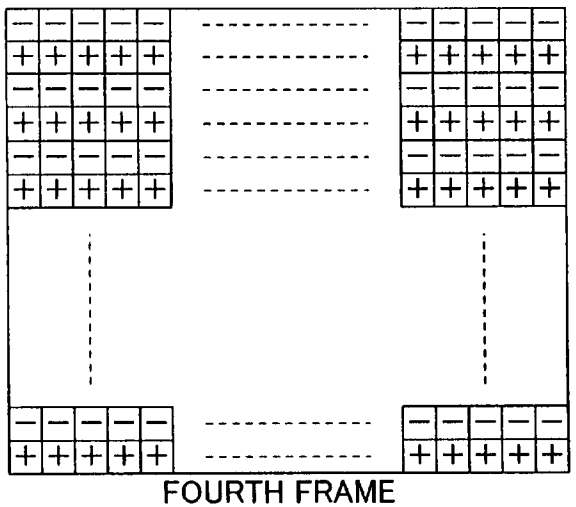

Incidentally, the liquid crystal display is driven by AC signals being applied to the pixel electrodes 3 in consideration of element properties. Therefore, if the liquid crystal display is driven at timings shown in FIG. 1, the pixels have polarity shown in, for example, FIG. 5(*a*) to FIG. 5(*d*), FIG. 6(*a*) to FIG. 6(*d*), and FIG. 7(*a*) to FIG. 7(*d*). FIG. 5(*a*) to FIG. 5(*d*) illustrate a "line-reversal drive scheme," FIG. 6(*a*) to FIG. 6(*d*) a "dot-reversal drive scheme," and FIG. 7(*a*) to FIG. 7(*d*) a "double-line-dot-reversal drive scheme." It would be understood that in each case, polarity reverses due to the AC driving, and the polarity of pixels is reversed in every two frames to avoid non-uniform polarity from occurring in the pixels.

Figure 7:
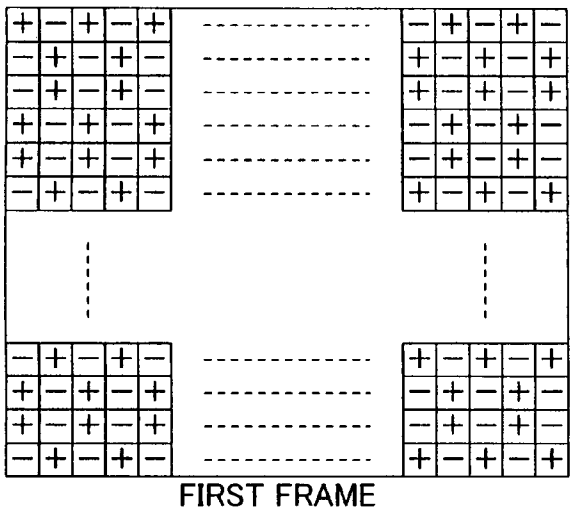
FIG. 7(*a*) to FIG. 7(*d*) are front views showing the display area of the liquid crystal display in polarity-reversal drive (double-line-dot-reversal drive).
Figure 7:
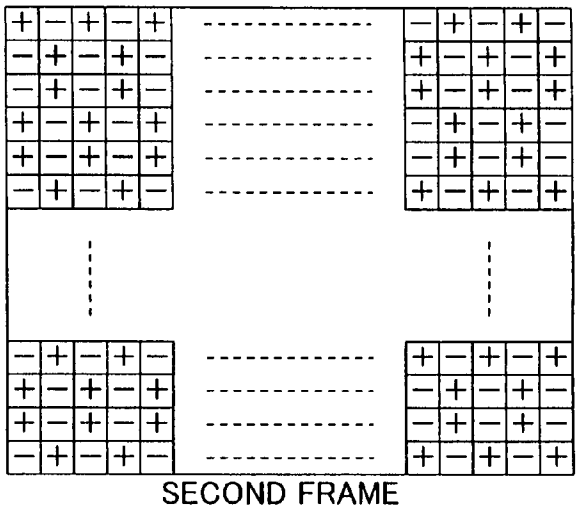
Figure 7:
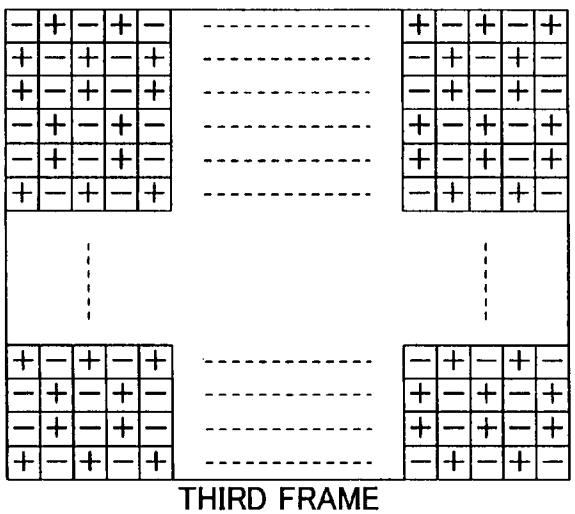
Figure 7:
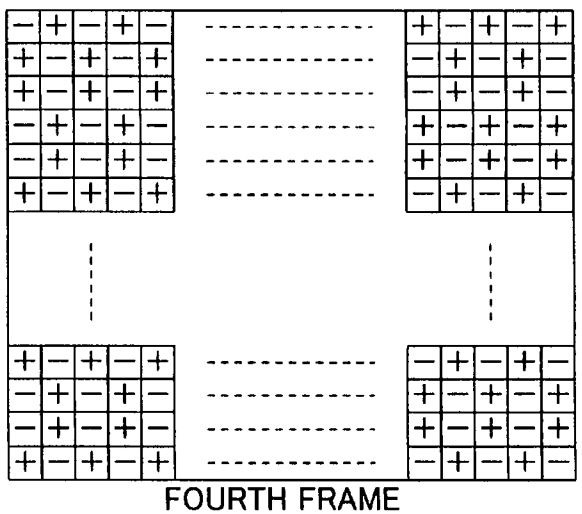
Figure 8:
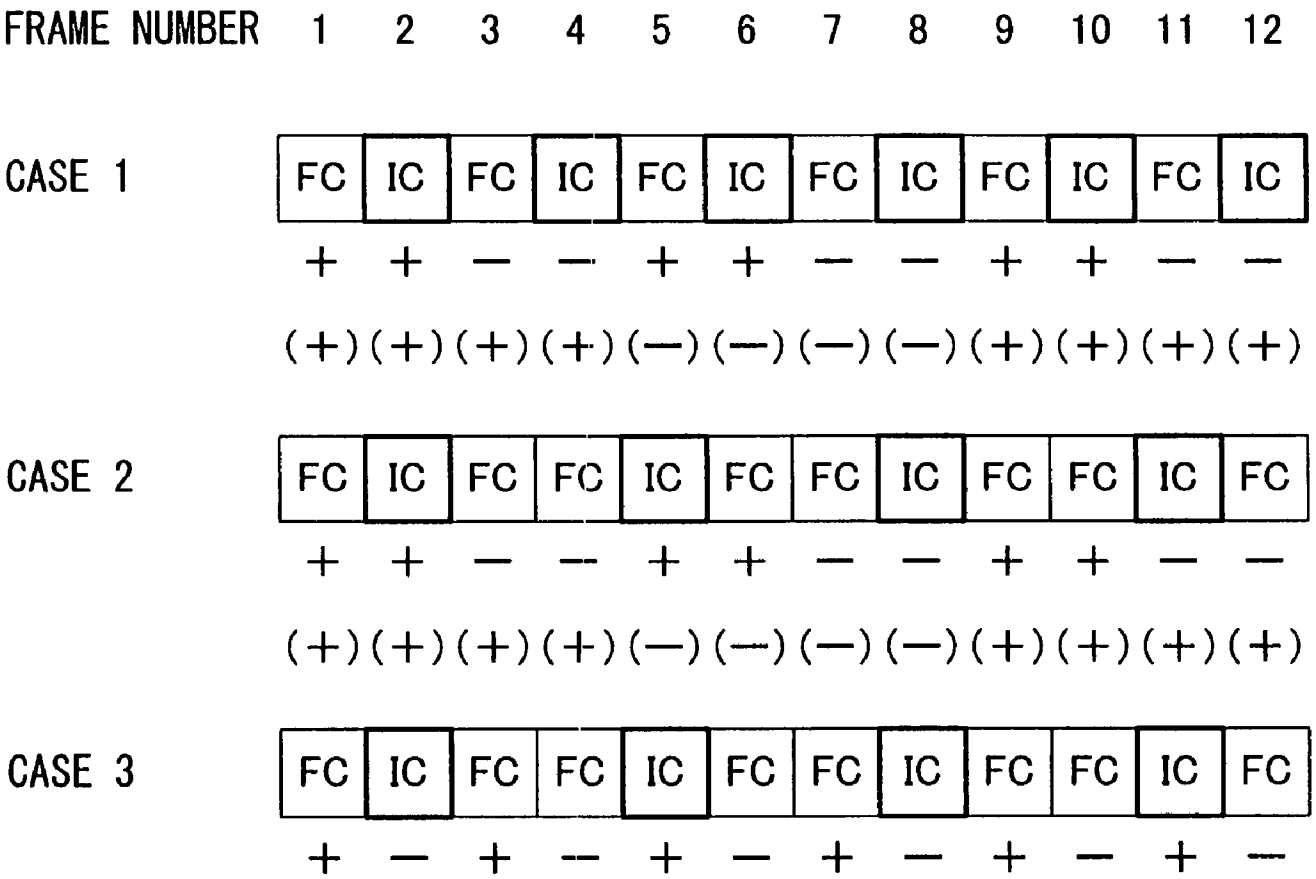
FIG. 8(*a*) to FIG. 8(*c*) are conceptual drawings showing display states of pixels in the liquid crystal display in polarity-reversal drive.

The charge states of the pixels in this polarity-reversal drive are shown in FIG. 8(*a*), FIG. 8(*b*), and FIG. 8(*c*). The polarity reversal in FIG. 6(*a*) to FIG. 6(*d*) and FIG. 7(*a*) to FIG. 7(*d*) corresponds to case 1 in FIG. 8(*a*) where full charging, or FC, occurs in odd-numbered frames, and imperfect charging, or IC, occurs in even-numbered frames.

Figure 6:
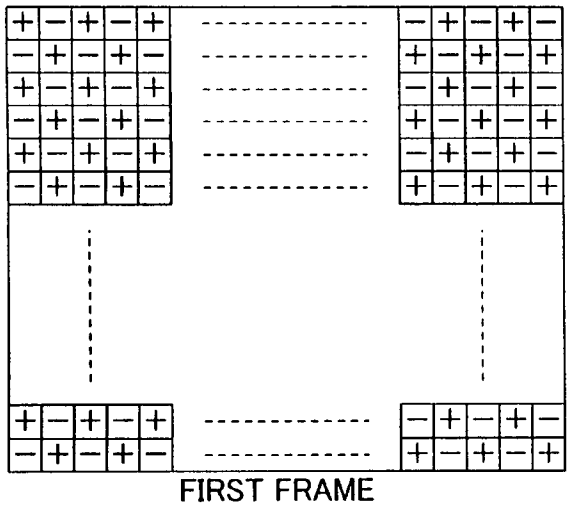
FIG. 6(*a*) to FIG. 6(*d*) are front views showing the display area of the liquid crystal display in polarity-reversal drive (dot-reversal drive).
Figure 6:
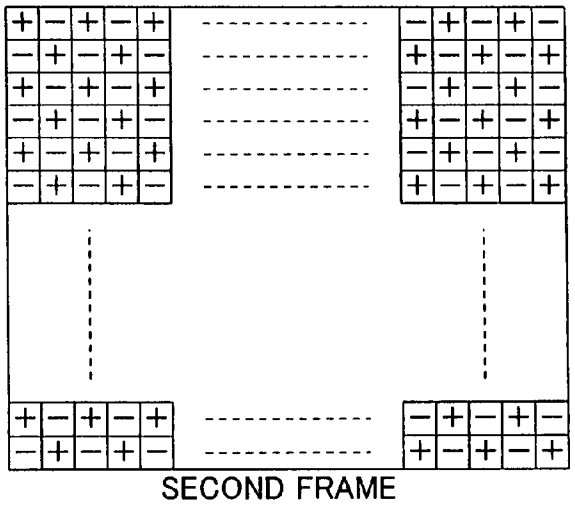
Figure 6:
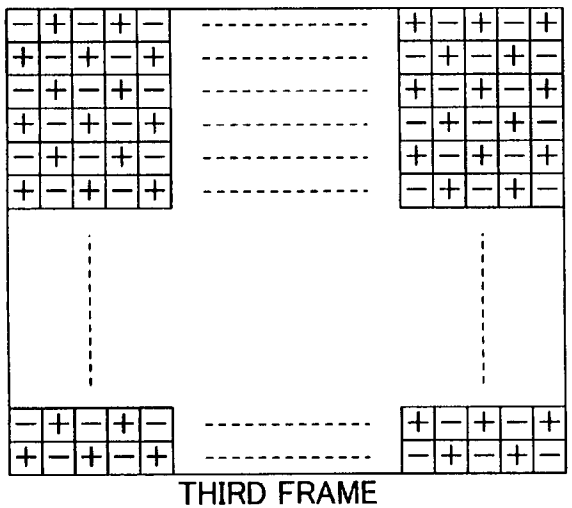
Figure 6:
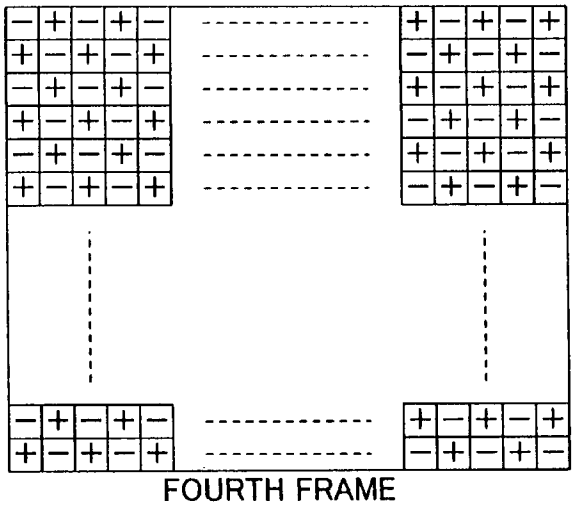

Polarity reverses in every two frames in FIG. 5(*a*) to FIG. 5(*d*), FIG. 6(*a*) to FIG. 6(*d*), and FIG. 7(*a*) to FIG. 7(*d*). It is needless to say however that for example, polarity may reverse in every four frames in case 1 as indicated in parentheses for case 1 in FIG. 8(*a*), provided that it be sufficient if the pixels are free from non-uniform polarity.

FIG. 8(*b*) shows another possibility, case 2, where the "FC, IC, FC" pattern is periodically repeated. The ratio of the full charge pixels (FC) and imperfect charge pixels (IC) is not necessarily 1:1. When this is the case, however, it is not preferred in terms of responsivity and to avoid unnecessary brightness fall if imperfect charge pixels (IC) appear successively for two or more frames, as mentioned previously.

Further, since it will be sufficient if a balance is struck with respect to polarity reversal of pixels, in case 2 of FIG. 8, the polarity of the pixel electrodes 3 may be switched in every four or another number of frames where necessary as shown in case 3 of FIG. 8(*c*). FIG. 8(*c*) shows case 3 where switching takes place in each frame.

As an application example of the polarity reversal, the polarity reversal cycle itself may be made variable. To, for example, vary the polarity reversal cycle at random, random data may be input in advance in a storage device, such as an assembled noise generator or a ROM (Read Only Memory), as a random signal source for polarity switching, for later retrieval.

Since flicker-free images, an advantage of the data-hold-type display, are effective when the video signals represent still images, the anti-afterimage measures are more effective when implemented in displaying moving images. To this end, information which discriminates between moving images/still images may be obtained from the CPU 11 so as to implement the anti-afterimage measures only when displaying moving images. As to the moving image/still image information here, grayscale level data may be compared between video signal frames; however, when, for example, the video signals are MPEG (Moving Picture Expert Group) encoded, the moving image/still image information may be obtained from a MPEG signal itself.

In this manner, according to the liquid crystal display, its driver device, and the display method for the liquid crystal display of the present embodiment, when displaying a video signal composed of a set of display frames, the data signal line drive circuits SD drive and display so that at least one display frame of that set of display frames will become a less-than-grayscale-level display frame where a data signal fed to a data signal line contains a signal less than the grayscale level represented by the video signal. Further, the less-than-grayscale-level signal is associated with the signal level in a preceding display frame.

In other words, the liquid crystal display has a data-hold property whereby when a data signal voltage is applied to a pixel electrode, an alignment state resulting from a change in accordance with the applied data signal voltage is held. Thus, afterimages occur when displaying moving images, causing display quality degradation.

The issue is addressed by the present embodiment: At least one of display frames is a less-than-grayscale-level display frame where a signal output level to an original data signal line is lower than a grayscale level display frame which is a level equal to or greater than the grayscale level represented by the video signal. The less-than-grayscale-level signal is associated with a signal level in a preceding display frame.

Therefore, external control enables liquid-crystal-based displays to produce displays like those on level-decay-type CRTs.

In addition, according to the present embodiment, since it is not that either the upper portion of the screen or the lower portion of the screen always produces a black display, overall brightness across the entire display screen does not fall.

Therefore, a liquid crystal display, its driver device, and a display method for the display can be provided which is capable of preventing display quality degradation due to afterimages observable in moving image displays without reducing screen brightness.

In addition, according to the liquid crystal display of the present embodiment, the data signal line drive circuits SD drive so as to render a display frame immediately before a less-than-grayscale-level display frame a grayscale level display frame.

Therefore, no successive less-than-grayscale-level display frames exist in which a lower level than the video signal is applied to a pixel. Brightness does not fall more than necessary. In addition, the display is advantageous also from the view point of responsivity.

In addition, in the liquid crystal display in accordance with the present embodiment, the data signal line drive circuit SD shifts an output timing to the data signal lines so that the signal output level to the data signal lines D is a lower grayscale level than the grayscale level represented by the video signal.

Therefore, brightness is not caused to fall more than necessary as in the case of simply inserting black between display frames.

In addition, in the liquid crystal display in accordance with the present embodiment, the data signal line drive circuit SD shifts the output timing to the data signal lines D; therefore, the data signal line drive circuit SD controls a timing for a latch signal. Further, the timing for a latch signal is preferably controlled for each vertical period.

Therefore, there is no need to process the video signal, making it easy to alter data. In addition, the regulation range remains in the latch signal setting range, achieving a wide and flexible regulation range.

In addition, in the liquid crystal display in accordance with the present embodiment, the data signal line drive circuit SD switches a signal polarity to the data signal lines for each pair of display frames, the pair being composed of the grayscale level display frame and the successive less-than-grayscale-level display frame. This prevents polarity from becoming non-uniform in a particular direction.

In addition, in the liquid crystal display in accordance with the present embodiment, the data signal line drive circuit SD switches reversal of a signal output polarity to the data signal lines D for every specific number of display frames or for every display frame, regardless of whether in the grayscale level display frame or in the less-than-grayscale-level display frame.

Therefore, even if the grayscale level display frame and the less-than-grayscale-level display frame do not make a pair, the signal polarity is prevented from becoming non-uniform in a particular direction.

In addition, in the liquid crystal display in accordance with the present embodiment, the data signal line drive circuit SD switches, at random, a display frame acting as a boundary between the grayscale level display frame and the less-than-grayscale-level display frame.

In addition, the data signal line drive circuit SD switches, at random, reversal of a signal output polarity to the data signal lines D with respect to a position of a frame acting as a boundary between the grayscale level display frame and the less-than-grayscale-level display frame, regardless of whether in the grayscale level display frame or in the less-than-grayscale-level display frame.

Therefore, especially, when a switching between the grayscale level display frame and the less-than-grayscale-level display frame is done at a predetermined cycle, although a fixed pattern (still image) causing a particular display quality degradation which is called a killer pattern may possibly exist, the present embodiment does not allow for the killer pattern due to the random character.

In addition, according to the liquid crystal display and the display method for a liquid crystal display in accordance with the present embodiment, the CPU 11 determines whether the video signal is a moving image composed of multiple display frames or a still image and drives and displays so as to, when the CPU 11 has determined that the video signal is a moving image, produce a less-than-grayscale-level display frame.

Therefore, inherently, the liquid crystal display has an advantage that still image displays are free from flickering. The advantage is retained by implementing the process of the present embodiment only to moving images. Hence, moving image capabilities can be improved while retaining the advantage of liquid crystal.

Embodiment 1 assumed that the CPU 11 as the determining means and the memory 12 as the storage means are provided inside the data signal line drive circuit SD. Needless to say, however, the CPU 11 and the memory 12 may be provided outside the data signal line drive circuit. In addition, for example, a level comparator may be used as an alternative to the CPU 11 as the determining means.

Embodiment 2

Figure 9:
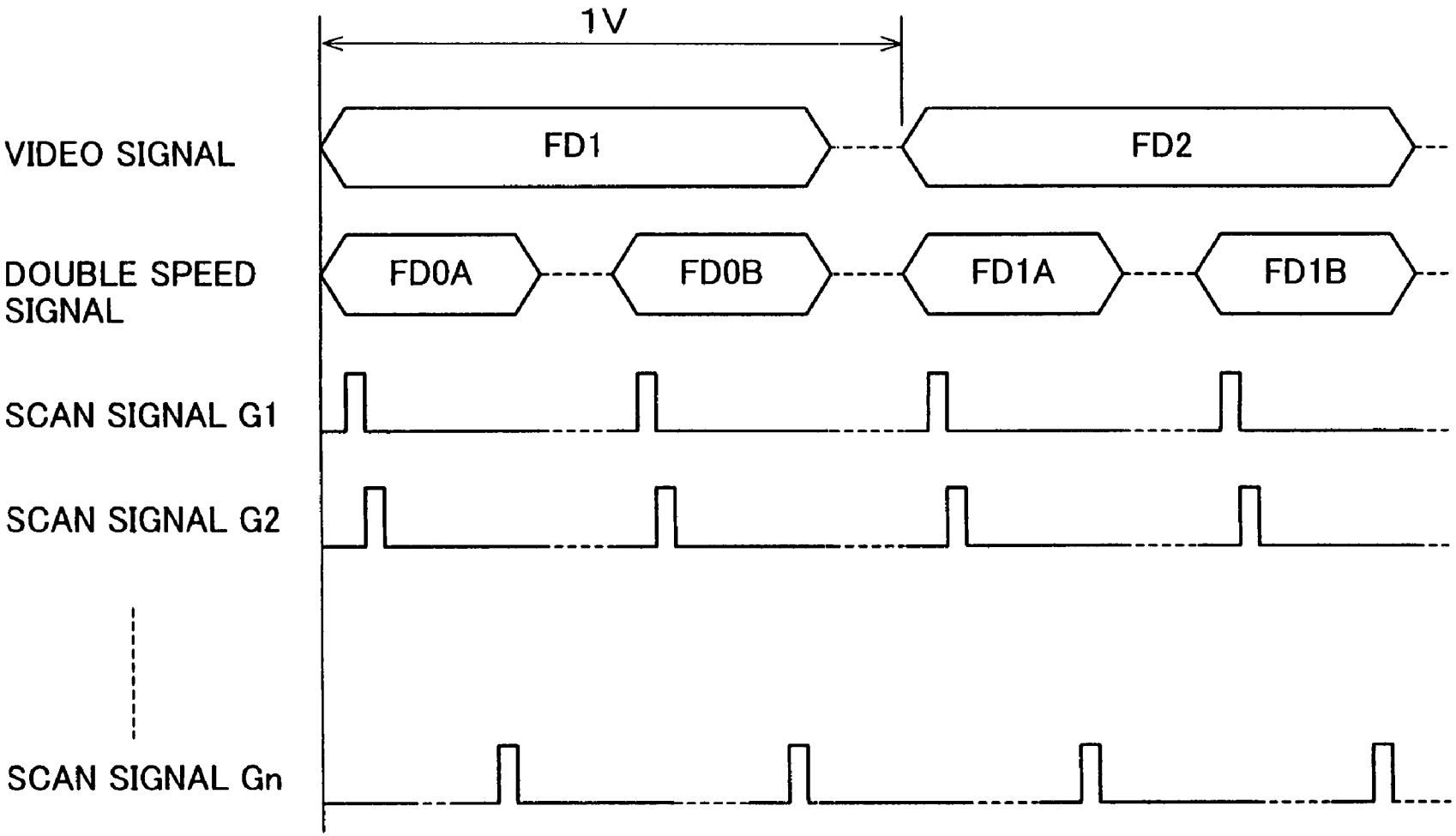
FIG. 9 is a timing chart schematically showing major drive signals for another embodiment of a liquid crystal display in accordance with the present invention.
Figure 10:
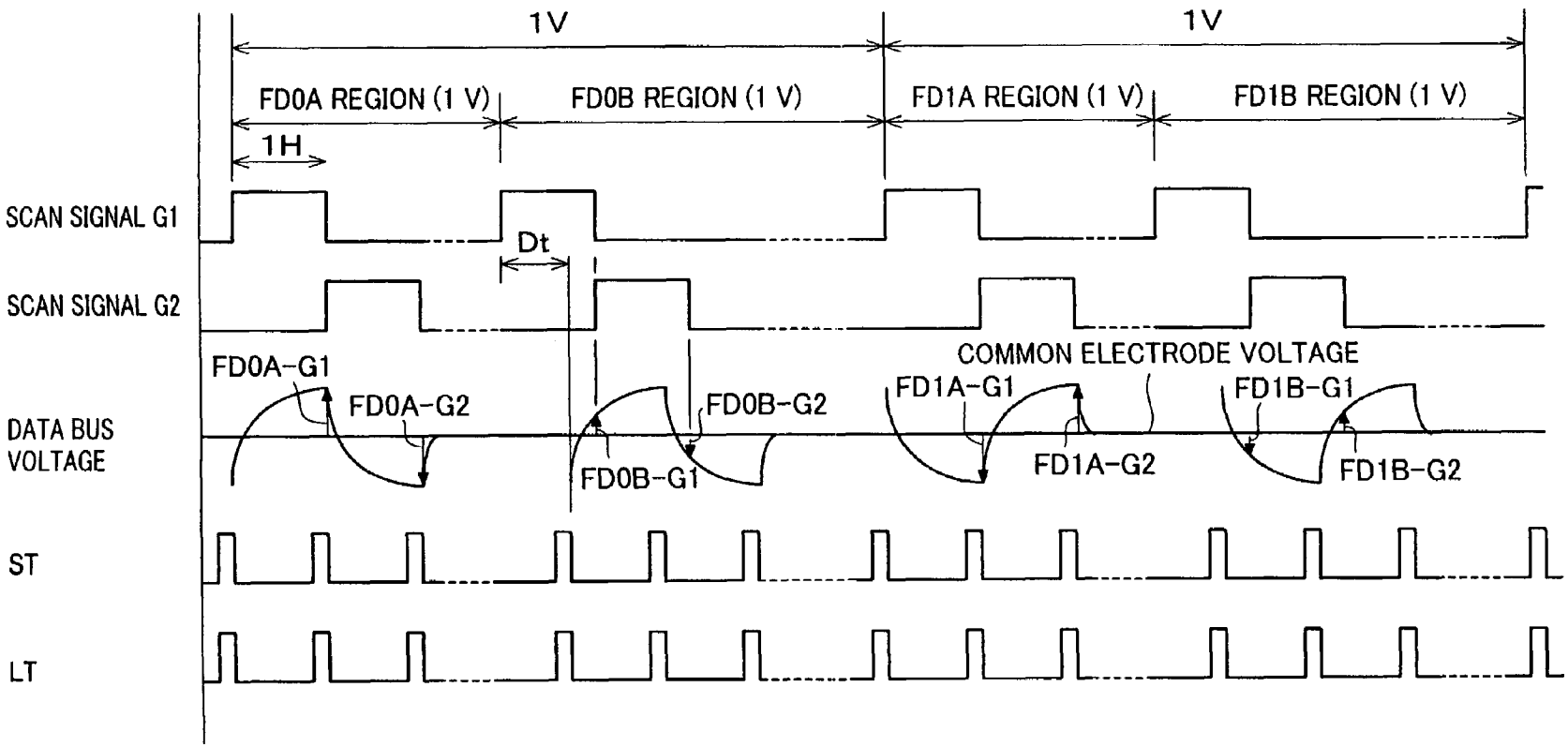
FIG. 10 is a timing chart showing major drive signals in details for the liquid crystal display.

The following will describe another embodiment of the present invention in reference to FIG. 9 and FIG. 10. The arrangement of the present embodiment is identical to that of embodiment 1 unless otherwise stated. Here, for convenience, members of the present embodiment that have the same arrangement and function as members of embodiment 1, and that are mentioned in that embodiment are indicated by the same reference numerals and description thereof is omitted.

A drive method for the liquid crystal display of the present embodiment will be described in reference to FIG. 9 and FIG. 10.

As shown in FIG. 9, video signals FD are fed to the liquid crystal display on each vertical synchronization (1V) in the order of FD0, FD1, FD2 . . .

Under these conditions, in the liquid crystal display of the present embodiment, writings to the memory 12 are done in synchronism with the inputs of the video signals FD, using the memory 12 of FIG. 2(*b*) which is capable of storing data for one frame. Therefore, in the present embodiment, when the video signal FD1 is input, the preceding video signal FD0 is output.

In addition, simultaneously with it, in the present embodiment, the video signals FD written to the memory 12 are output at least twice in at least one vertical period (1V) of a video signal. In FIG. 9, the video signals are output as double speed signals. In other words, it is shown that a video signal FD0A which is a double speed signal is identical to a video signal FD0B which is a double speed signal and also that a video signal FD1A which is a double speed signal is identical to a video signal FD1B which is a double speed signal.

FIG. 10 shows signals for a particular one of the pixels under the foregoing circumstances. Detailed discussion is omitted here regarding the signals in FIG. 10, because they are basically identical to those in FIG. 1.

Now, paying attention to the phase relationship between the scan signals G1, G2 and the latch pulses LT in the figure, in the present embodiment, switching is done so that the video signal FD0A region and the video signal FD1A region indicate fully charged pixels (FD0A-G1, FD0A-G2, FD1A-G1, FD1A-G2) and that the video signal FD0B region and the video signal FD1B region indicate imperfectly charged pixels (FD0B-G1, FD0B-G2, FD1B-G1, FD 1B-G2).

Therefore, the latch pulse LT is turned on simultaneously with the first rise of the scan signal G1 at the first output in a vertical period (1V), whereas at the second output in the vertical period (1V), the latch pulse LT is turned on when the difference Dt has elapsed after a second rise of the scan signal G1.

This enables data-hold-type displays like the liquid crystal display to be driven in a similar manner to the CRT. In addition, the full charge pixels certainly involve original video signals; therefore, as the video signals per se, anti-afterimage measures can be implemented while retaining the frame rate. This is an effect achieved by the present embodiment, not by embodiment 1.

The foregoing description assumed that full charging took place in the video signal FD0A and the video signal FD1A regions and that imperfect charge took place in the video signal FD0B and the video signal FD1B regions, that is, a full charge frame and an imperfect charge frame recurred alternately. This is not the only possible method. However, it is considered more effective in terms of ensuring responsivity and brightness if those pixels in a frame immediately before imperfectly charged pixels are fully charged pixels. This was already explained in embodiment 1 too.

As explained in embodiment 1, the liquid crystal display is driven by AC signals applied to the pixel electrodes in consideration of element properties. Implementing the pixel polarity arrangements shown in FIG. 5(*a*) to FIG. 5(*d*), FIG. 6(*a*) to FIG. 6(*d*), and FIG. 7(*a*) to FIG. 7(*d*) at drive timings of FIG. 10 will results in:

In all the cases shown in FIG. 5(*a*) to FIG. 5(*d*) (line-reversal drive), FIG. 6(*a*) to FIG. 6(*d*) (dot-reversal drive), and FIG. 7(*a*) to FIG. 7(*d*), the polarity of pixels is reversed in every two frames to avoid non-uniform polarity from occurring in the pixels. A frame here refers to FD0A, FD0B, FD1A, FD1B in FIG. 10. That is, although the polarity is reversed in every two frames in the cases of FIG. 5(*a*) to FIG. 5(*d*), FIG. 6(*a*) to FIG. 6(*d*), and FIG. 7(*a*) to FIG. 7(*d*), the "two frames" does not refer to one frame of video signals fed to the liquid crystal display, but the timings for signals output to a signal (data bus) to the data signal lines D. This holds true also for the frame numbers in FIG. 8(*a*), FIG. 8(*b*), and FIG. 8(*c*).

The rest of the description will not be detailed, since it will be the same as the counterpart in embodiment 1. Data-hold-type displays like the liquid crystal display can be driven in a similar manner to the CRT. In addition, the full charge pixels certainly involve original video signals; therefore, as the video signals per se, anti-afterimage measures can be implemented while retaining the frame rate. This is an effect achieved by the present embodiment, not by embodiment 1. Similarly to embodiment 1, the anti-afterimage measures are more effective when implemented in displaying moving images.

In addition, both embodiment 1 and embodiment 2 assumed that the present invention was applied, as an example, to the active matrix data-hold-type display. Alternatively, needless to say, the invention is applicable to passive data-hold-type displays.

In this manner, according to the liquid crystal display, its driver device, and the display method for a liquid crystal display in accordance with the present embodiment, first, the memory 12 stores video signal data for at least one display frame in a video signal composed of multiple display frames. The stored video signal data for one display frame are output n times at n-times speed (n is an integer greater than or equal to 2) in one vertical period. Driving and displaying in at least one of the n-time speed display frames are done so as to produce a less-than-grayscale-level display frame where a data signal fed to the data signal lines contains a signal less than a grayscale level represented by the video signal. The signal less than the grayscale level is associated with a signal level in a preceding display frame.

In the liquid crystal display controlled at timings of embodiment 1, there is a need to apply to pixels after causing a decay as a less-than-grayscale-level display frame; therefore, unless the video signal frame rate is sufficiently high, the less-than-grayscale-level display frame appears flickering in some cases.

However, under the control at timings of the present embodiment, the video signal is temporarily converted to n-times speed. One of the two is treated as a grayscale level display frame, and the other as a less-than-grayscale-level display frame. As a result, there is no decrease in frame rate when compared to the original video signal. Thus, no flickers occur.

This ensures that a liquid crystal display, its driver device, and a display method for a liquid crystal display is provided which is capable of preventing display quality degradation due to afterimages observable in moving image displays without reducing screen brightness.

In addition, in the liquid crystal display in accordance with in the present embodiment, the data signal line drive circuit SD drives, with respect to a display frame immediately before the less-than-grayscale-level display frame, so as to produce a grayscale level display frame.

Therefore, no successive less-than-grayscale-level display frames exist in which a lower level than the video signal is applied to a pixel. Brightness does not fall more than necessary. In addition, the display is advantageous also in terms of responsivity.

In addition, in the liquid crystal display in accordance with the present embodiment, the data signal line drive circuit SD shifts an output timing to the data signal lines so that the signal output level to the data signal lines D is a lower grayscale level than the grayscale level represented by the video signal.

Therefore, brightness is not caused to fall more than necessary as in the case of simply inserting black between display frames.

In addition, in the liquid crystal display in accordance with the present embodiment, the data signal line drive circuit SD shifts the output timing to the data signal lines D; therefore, the data signal line drive circuit SD controls a timing for a latch signal. Further, the timing for a latch signal is preferably controlled for every n-times speed display frame.

Therefore, there is no need to process the video signal, making it easy to alter data. In addition, the regulation range remains in the latch signal setting range, achieving a wide and flexible regulation range.

In addition, in the liquid crystal display in accordance with the present embodiment, the data signal line drive circuit SD switches a signal polarity to the data signal lines for each pair of display frames, the pair being composed of the grayscale level display frame and the successive less-than-grayscale-level display frame. This prevents polarity from becoming non-uniform in a particular direction.

In addition, in the liquid crystal display in accordance with the present embodiment the data signal line drive circuit SD switches, at random, reversal of a signal output polarity to the data signal lines D with respect to a position of a frame acting as a boundary between the grayscale level display frame and the less-than-grayscale-level display frame, regardless of whether in the grayscale level display frame or in the less-than-grayscale-level display frame.

Therefore, especially, when a switching between the grayscale level display frame and the less-than-grayscale-level display frame is done at a predetermined cycle, although a fixed pattern (still image) causing a particular display quality degradation which is called a killer pattern may possibly exist, the present embodiment does not allow for the killer pattern due to the random character.

In addition, according to the liquid crystal display and the display method for a liquid crystal display in accordance with the present embodiment, the CPU 11 determines whether the video signal is a moving image composed of multiple display frames or a still image and drives and displays so as to, when the CPU has determined that the video signal is a moving image, produce a less-than-grayscale-level display frame.

Therefore, inherently, the liquid crystal display has an advantage that still image displays are free from flickering. The advantage is retained by implementing the process of the present embodiment only to moving images. Hence, moving image capabilities can be improved while retaining the advantage of liquid crystal.

Embodiment 2 assumed that the CPU 11 as the determining means and the memory 12 as the storage means are provided inside the data signal line drive circuit SD. Needless to say, however, the CPU 11 and the memory 12 may be provided outside the data signal line drive circuit. In addition, for example, a level comparator may be used as an alternative to the CPU 11 as the determining means.

Embodiment 3

Figure 11:
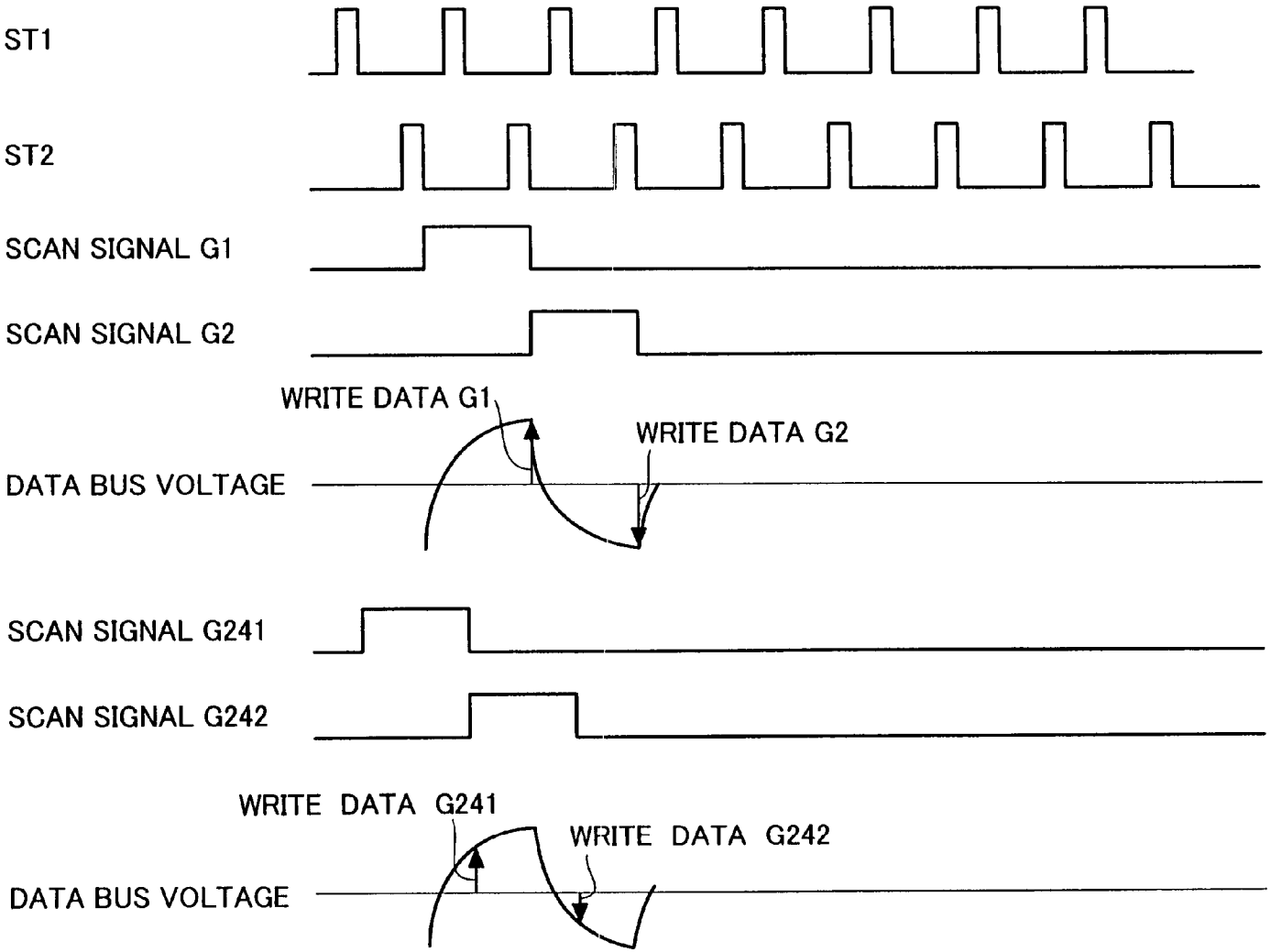
FIG. 11 is a timing chart schematically showing major drive signals for another embodiment of a liquid crystal display in accordance with the present invention.
Figure 12:
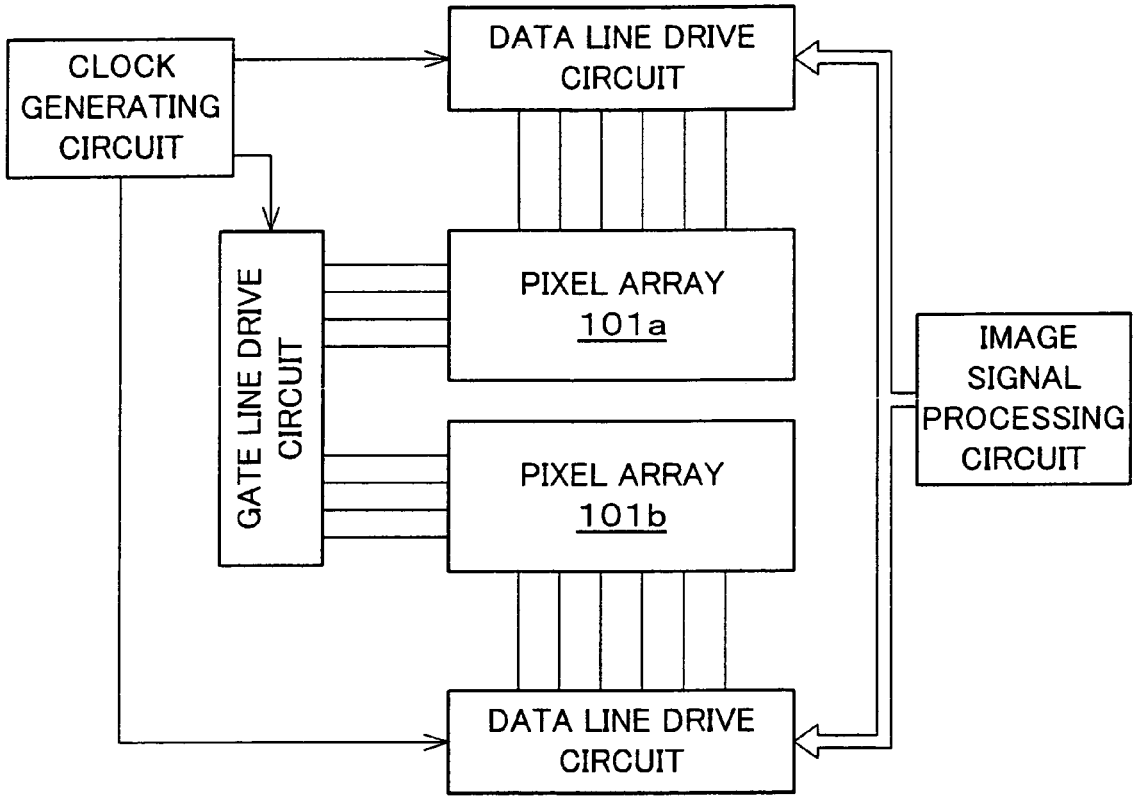
FIG. 12 is a front view showing a conventional liquid crystal display.

The following will describe another embodiment of the present invention in reference to FIG. 11. The arrangement of the present embodiment is identical to that of embodiment 1 unless otherwise stated. Here, for convenience, members of the present embodiment that have the same arrangement and function as members of embodiments 1, 2, and that were mentioned in those embodiments are indicated by the same reference numerals and description thereof is omitted.

In embodiments 1, 2, charging was switched between full charging and imperfect charging from one frame to another. Alternatively, full charging and imperfect charging may be mixed between frames.

For example, the drive method described in patent document 1 writes an image signal to lines and a black level signal to other lines in one frame. The method, in a sense, writes a mixed signal of an image signal and a black level signal in one frame.

However, the display disclosed in Japanese unexamined patent application 11-109921/1999 (Tokukaihei 11-109921; published on Apr. 23, 1999) mentioned earlier, to implement the driving, are divided along the columns whereby a black level signal is written to one of the two divisions while an image signal is being written to the other division. This means that patent document 1 inevitably requires that the panel be both electrically and physically divided.

In contrast, in the present embodiment, to charge a pixel with a signal equivalent to black level, the output timing for a scan signal for pixel charging only needs to be shifted. Therefore, some scan lines can be fully charged with others being imperfectly charged in one frame.

Figure 13:
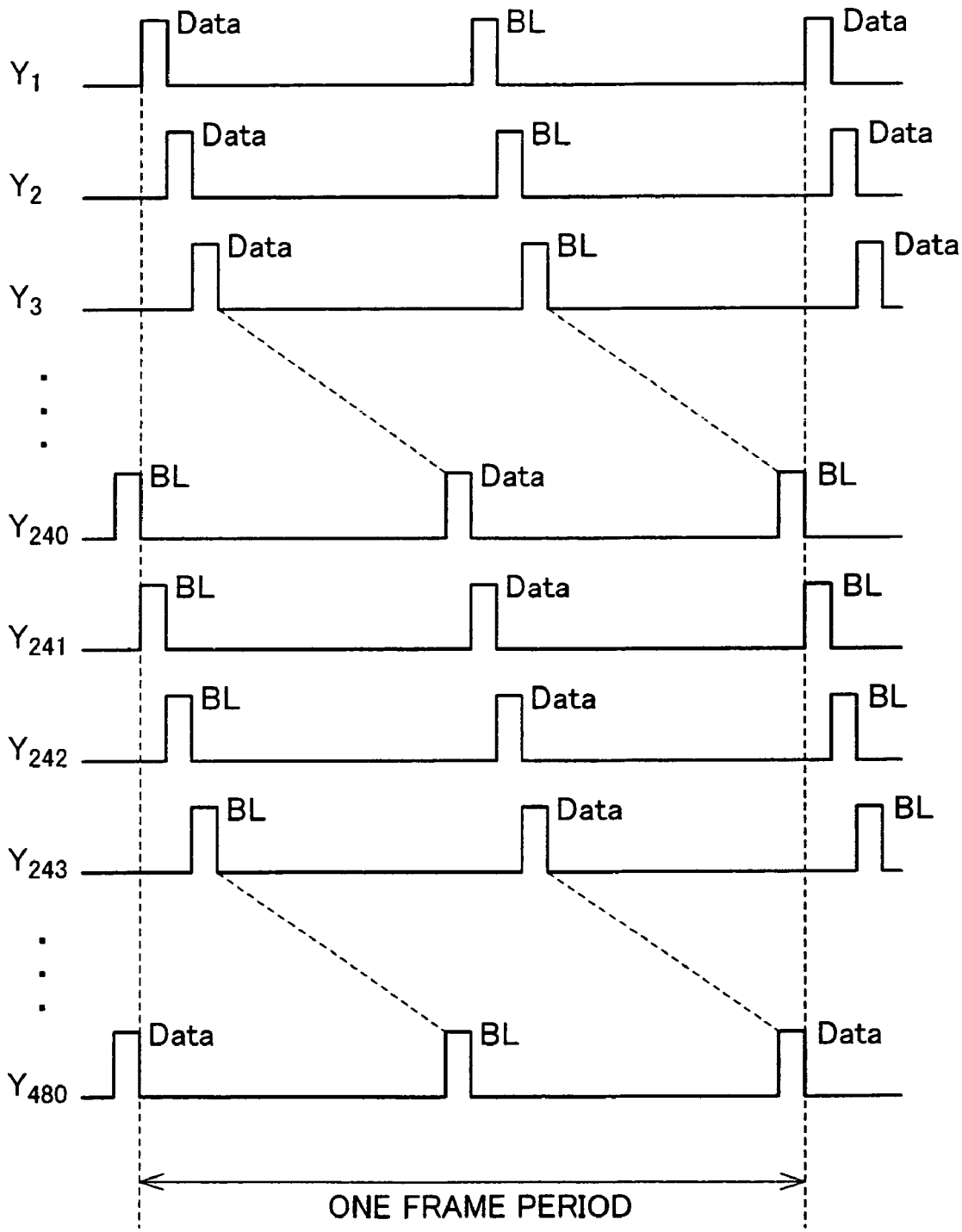
FIG. 13 a timing chart schematically showing major drive signals for the liquid crystal display.

Specifically, as shown in FIG. 13, the scan lines G1, G2 are fully charged with an image signal using a start pulse SP2, and the scan lines G241, G242 are imperfectly charged so that a signal equivalent to black level is written using the start pulse SP1. In other words, even if the data bus lines are common, both full charging (ordinary image data writing) and imperfect charging (black level signal data writing) are achieved by varying the switch timing for the scan signal. Specifically, a switching is done between the start pulse SP1 and the start pulse SP2 for each scan signal line G or each set of scan signal lines G.

Therefore, control is simple. In addition, there is no need to divide the display area as in patent document 1. The objective is achieved at low cost.

Note however that in the driving illustrated in the timing chart in FIG. 13, there is a need to shift a timing from the scan signal G1 and a timing from the scan signal G241. This is for the purpose of varying the charge time.

In this manner, according to an active matrix liquid crystal display as the display of the present embodiment, a scan signal lines drive circuit (gate driver) GD and a data signal line drive circuit (data driver) SD, as its driver device, and a display method for such a display, the scan signal lines drive circuits (gate drivers) GD and the data signal line drive circuits (data drivers) SD as the third drive means drives, in one display frame, a mixture of a grayscale level display where a data signal fed to the data signal lines D represents the video signal and a less-than-grayscale-level display where the data signal fed to the data signal lines D contains a signal less than a grayscale level represented by the video signal, by shifting an output timing. The signal less than the grayscale level is associated with a signal level in a preceding display.

Thus, a liquid crystal display, its driver device, and a display method for the display can be provided which is capable of preventing display quality degradation due to afterimages observable in moving image displays without reducing screen brightness in one display frame.

In addition, according to an active matrix liquid crystal display as the display of the present embodiment, a scan signal lines drive circuit (gate driver) GD and a data signal line drive circuit (data driver) SD, as its driver device, and a display method for such a display, the control circuit CNT as the output timing switching means switches for each scan signal line G or each set of scan signal lines G in one display frame between an output timing at which a grayscale level display represented by the video signal to the pixels is produced and an output timing at which the less-than-grayscale-level display is produced. Thus, there is no need to divide the display area as in conventional examples; output timings can be switched easily and inexpensively.

The embodiments described so far are for illustrative purposes only and by no means limit the scope of the present invention. Variations are not to be regarded as a departure from the spirit and scope of the invention, and all such modifications as would be obvious to one skilled in the art are intended to be included within the scope of the claims below.

As in the foregoing, in the display in accordance with the present invention, the first drive means drives, with respect to a display frame immediately before the less-than-grayscale-level display frame, so as to produce a grayscale level display frame where a signal output level to the data signal lines is greater than, or equal to, the grayscale level represented by the video signal.

In addition, in the display in accordance with the present invention, the second drive means drives, with respect to a n-time speed display frame immediately before the less-than-grayscale-level display frame, so as to produce a grayscale level display frame where a signal output level to the data signal lines is greater than, or equal to, the grayscale level represented by the video signal.

According to the invention, the first drive means and the second drive means drives, with respect to a display frame immediately before the less-than-grayscale-level display frame, to produce a grayscale level display frame.

Therefore, no successive less-than-grayscale-level display frames exist in which a lower level than the video signal is applied to a pixel. Brightness does not fall more than necessary. In addition, the display is advantageous also in terms of responsivity.

In addition, in the display in accordance with the present invention, the first drive means shifts an output timing to the data signal lines so that the signal output level to the data signal lines is a lower grayscale level than the grayscale level represented by the video signal.

In addition, in the display in accordance with the present invention, the second drive means shifts an output timing to the data signal lines so that the signal output level to the data signal lines is a lower grayscale level than the grayscale level represented by the video signal.

According to the invention, the first drive means and the second drive means shift an output timing to the data signal lines so that the signal output level to the data signal lines is a lower grayscale level than the grayscale level represented by the video signal.

Therefore, brightness is not caused to fall more than necessary as in the case of simply inserting black between display frames.

In addition, in the display in accordance with the present invention, the first drive means shifts an output timing to the data signal lines; the first drive means controls a timing for a latch signal.

In addition, in the display in accordance with the present invention, the second drive means shifts an output timing to the data signal lines; therefore, the second drive means controls a timing for a latch signal.

In addition, in the display in accordance with the present invention, the first drive means shifts an output timing to the data signal lines; therefore, the first drive means controls a timing for a latch signal for each vertical period.

In addition, in the display in accordance with the present invention, the second drive means shifts an output timing to the data signal lines; therefore, the second drive means controls a timing for a latch signal for every n-times speed display frame.

According to the invention, the first drive means and the second drive means shift the output timing to the data signal lines; therefore, the first drive means and the second drive means control a timing for a latch signal. Further, the timing for a latch signal is preferably controlled for each vertical period or for every n-times speed display frame.

Therefore, there is no need to process the video signal, making it easy to alter data. In addition, the regulation range remains in the latch, achieving a wide and flexible regulation range.

In addition, in the display in accordance with the present invention, the first drive means switches a signal polarity to the data signal lines for each pair of display frames, the pair being composed of the grayscale level display frame and the successive less-than-grayscale-level display frame.

In addition, in the display in accordance with the present invention, the second drive means switches a signal polarity to the data signal lines for each pair of display frames, the pair being composed of the grayscale level display frame and the successive less-than-grayscale-level display frame.

According to the invention, the first drive means and the second drive means switch a signal polarity to the data signal lines for each pair of display frames, the pair being composed of the grayscale level display frame and the successive less-than-grayscale-level display frame.

This prevents polarity from becoming non-uniform in a particular direction.

In addition, in the display in accordance with the present invention, the first drive means switches reversal of a signal output polarity to the data signal lines for every specific number of display frames, regardless of whether in the grayscale level display frame or in the less-than-grayscale-level display frame.

In addition, in the display in accordance with the present invention, the first drive means switches reversal of a signal output polarity to the data signal lines for every display frame, regardless of whether in the grayscale level display frame or in the less-than-grayscale-level display frame.

According to the invention, even if the grayscale level display frame and the less-than-grayscale-level display frame do not make a pair, the signal polarity is prevented from becoming non-uniform in a particular direction.

In addition, in the display in accordance with the present invention, the first drive means switches, at random, a display frame acting as a boundary between the grayscale level display frame and the less-than-grayscale-level display frame.

In addition, in the display in accordance with the present invention, the second drive means switches, at random, reversal of a signal output polarity to the data signal lines with respect to a position of a frame acting as a boundary between the grayscale level display frame and the less-than-grayscale-level display frame, regardless of whether in the grayscale level display frame or in the less-than-grayscale-level display frame.

In addition, in the display in accordance with the present invention, the first drive means switches, at random, reversal of a signal output polarity to the data signal lines with respect to a position of a frame acting as a boundary between the grayscale level display frame and the less-than-grayscale-level display frame, regardless of whether in the grayscale level display frame or in the less-than-grayscale-level display frame.

According to the invention, the first drive means switches, at random, a display frame acting as a boundary between the grayscale level display frame and the less-than-grayscale-level display frame.

In addition, the first drive means and the second drive means switch, at random, reversal of a signal output polarity to the data signal lines with respect to a position of a frame acting as a boundary between the grayscale level display frame and the less-than-grayscale-level display frame, regardless whether in the grayscale level display frame or in the less-than-grayscale-level display frame.

Therefore, especially, when a switching between the grayscale level display frame and the less-than-grayscale-level display frame is done at a predetermined cycle, although a fixed pattern (still image) causing a particular display quality degradation which is called a killer pattern may possibly exist, the present invention does not allow for the killer pattern due to the random character.

In addition, in the display in accordance with the present invention, the first drive means includes determining means determining whether the video signal is a moving image composed of multiple display frames or a still image and driving so as to, when the determining means has determined that the video signal is a moving image, produce a less-than-grayscale-level display frame.

In addition, in the display in accordance with the present invention, the second drive means includes determining means determining whether the video signal is a moving image composed of multiple display frames or a still image and driving so as to, when the determining means has determined that the video signal is a moving image, produce a less-than-grayscale-level display frame.

In addition, according to the display method for a display in accordance with the present invention, it is determined whether the video signal is a moving image composed of multiple display frames or a still image, and when it is determined that the video signal is a moving image, a display is done to produce a less-than-grayscale-level display frame.

According to the invention, the determining means determines whether the video signal is a moving image composed of multiple display frames or a still image and drives and displays so as to, when the determining means has determined that the video signal is a moving image, produce a less-than-grayscale-level display frame.

Therefore, inherently, the display has an advantage that still image displays are free from flickering. The advantage is retained by implementing the process in accordance with the present invention only to moving images. Hence, moving image capabilities can be improved while retaining the advantage of the data-hold-type element.

In addition, in the display in accordance with the present invention, the third drive means includes output timing switching means switching for each scan signal line or each set of scan signal lines in one display frame between an output timing at which a grayscale level display represented by the video signal to the pixels is produced and an output timing at which the less-than-grayscale-level display is produced.

In addition, in the driver device for a display in accordance with the present invention, the third drive means includes output timing switching means switching for each scan signal line or each set of scan signal lines in one display frame between an output timing at which a grayscale level display represented by the video signal to the pixels is produced and an output timing at which the less-than-grayscale-level display is produced.

In addition, according to the display method for a display in accordance with the present invention, a switching between an output timing at which a grayscale level display represented by the video signal to the pixels is produced and an output timing at which the less-than-grayscale-level display is produced is done for each scan signal line or each set of scan signal lines in one display frame.

According to the invention, the output timing switching means can switch for each scan signal line or each set of scan signal lines in one display frame between an output timing at which a grayscale level display represented by the video signal to the pixels is produced and an output timing at which the less-than-grayscale-level display is produced. Thus, there is no need to divide the display area as in conventional examples; output timings can be switched easily and inexpensively.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display, comprising:

scan signal lines:

data signal lines fed with a video signal as a data signal;

a display section in which pixels are arranged to form a matrix, the pixels being connected via switching sections correspondingly to intersections of the scan signal lines and the data signal lines;

first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than said level is associated with a signal level in a preceding display frame, and either a pattern of a fully charged display frame immediately followed by a partially charged display frame is periodically repeated, or a pattern of plural, successive fully charged display frames and a single partially charged display frame is periodically repeated.

2. A display, comprising:

scan signal lines:

data signal lines fed with a video signal as a data signal;

a display section in which pixels are arranged to form a matrix, the pixels being connected via switching sections correspondingly to intersections of the scan signal lines and the data signal lines;

first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than said level is associated with a signal level in a preceding display frame, and wherein the first drive means shifts an output timing to the data signal lines so that the signal output level to the data signal lines is a level lower than the level represented by the video signal.

3. A display, comprising:

scan signal lines:

data signal lines fed with a video signal as a data signal;

a display section in which pixels are arranged to form a matrix, the pixels being connected via switching sections correspondingly to intersections of the scan signal lines and the data signal lines;

first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than the level represented by the video signal is associated with a signal level in a preceding display frame, and wherein the first drive means controls a timing for a latch signal to shift an output timing to the data signal lines.

4. A display, comprising:

scan signal lines:

data signal lines fed with a video signal as a data signal;

a display section in which pixels are arranged to form a matrix, the pixels being connected via switching sections correspondingly to intersections of the scan signal lines and the data signal lines;

first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than the level represented by the video signal is associated with a signal level in a preceding display frame, and wherein the first drive means controls a timing for a latch signal for each vertical period to shift an output timing to the data signal lines.

5. The display as set forth in claim 1, wherein the first drive means includes determining means determining whether the video signal is a moving image composed of multiple display frames or a still image and driving so as to, when the determining means has determined that the video signal is a moving image, produce a partially charged display frame.

6. A display, comprising:

scan signal lines:

data signal lines fed with a video signal as a data signal;

a display section in which pixels are arranged to form a matrix, the pixels being connected via switching sections correspondingly to intersections of the scan signal lines and the data signal lines; and first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than said level is associated with a signal level in a preceding display frame, wherein the first drive means drives, with respect to a display frame immediately before the partially charged display frame, so as to produce a fully charged display frame where a signal output level to the data signal lines is greater than, or equal to, the level represented by the video signal, and wherein the first drive means switches a signal polarity to the data signal lines for each pair of display frames, the pair being composed of the fully charged display frame and the successive partially charged display frame.

7. A display, comprising:

scan signal lines:

data signal lines fed with a video signal as a data signal;

a display section in which pixels are arranged to form a matrix, the pixels being connected via switching sections correspondingly to intersections of the scan signal lines and the data signal lines;

first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than said level is associated with a signal level in a preceding display frame, wherein the first drive means drives, with respect to a display frame immediately before the partially charged display frame, so as to produce a fully charged display frame where a signal output level to the data signal lines is greater than, or equal to, the level represented by the video signal, and wherein the first drive means switches reversal of a signal output polarity to the data signal lines for every specific number of display frames, regardless of whether in the fully charged display frame or in the partially charged display frame.

8. A display, comprising:

scan signal lines:

data signal lines fed with a video signal as a data signal;

a display section in which pixels are arranged to form a matrix, the pixels being connected via switching sections correspondingly to intersections of the scan signal lines and the data signal lines;

first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than said level is associated with a signal level in a preceding display frame, wherein the first drive means drives, with respect to a display frame immediately before the partially charged display frame, so as to produce a fully charged display frame where a signal output level to the data signal lines is greater than, or equal to, the level represented by the video signal, and wherein the first drive means switches reversal of a signal output polarity to the data signal lines for every display frame, regardless of whether in the fully charged display frame or in the partially charged display frame.

9. A display, comprising:

scan signal lines:

data signal lines fed with a video signal as a data signal;

a display section in which pixels are arranged to form a matrix, the pixels being connected via switching sections correspondingly to intersections of the scan signal lines and the data signal lines;

first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than said level is associated with a signal level in a preceding display frame, wherein the first drive means drives, with respect to a display frame immediately before the partially charged display frame, so as to produce a fully charged display frame where a signal output level to the data signal lines is greater than, or equal to, the level represented by the video signal, and wherein the first drive means switches, at random, a display frame acting as a boundary between the fully charged display frame and the partially charged display frame.

10. A display, comprising:

scan signal lines:

data signal lines fed with a video signal as a data signal;

a display section in which pixels are arranged to form a matrix, the pixels being connected via switching sections correspondingly to intersections of the scan signal lines and the data signal lines;

first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than said level is associated with a signal level in a preceding display frame, wherein the first drive means drives, with respect to a display frame immediately before the partially charged display frame, so as to produce a fully charged display frame where a signal output level to the data signal lines is greater than, or equal to, the level represented by the video signal, and wherein the first drive means switches, at random, reversal of a signal output polarity to the data signal lines with respect to a position of a frame acting as a boundary between the fully charged display frame and the partially charged display frame, regardless of whether in the fully charged display frame or in the partially charged display frame.

11. A display, comprising:

scan signal lines;

data signal lines fed with a video signal as a data signal;

a display section in which pixels are arranged to form a matrix, the pixels being connected via switching sections correspondingly to intersections of the scan signal lines and the data signal lines;

storage means storing video signal data for at least one display frame in a video signal composed of multiple display frames;

second drive means (i) causing n outputs of the video signal data for one display frame stored in the storage means at n-times speed (n is an integer greater than or equal to 2) in one vertical period and (ii) driving in at least one of the n n-time speed display frames so as to produce a partially charged display frame where a data signal fed to the data signal lines contains a signal having a level less than a level represented by the video signal, wherein the signal having a level less than said level is associated with a signal level in a preceding display frame, and either a pattern of fully charged display frame immediately followed by a partially charged display frame is periodically repeated, or a pattern of plural, successive fully charged display frames and a single partially charged display frame is periodically repeated.

12. The display as set forth in claim 11, wherein the second drive means shifts an output timing to the data signal lines so that the signal output level to the data signal lines is a level lower than the level represented by the video signal.

13. The display as set forth in claim 11, wherein the second drive means includes determining means determining whether the video signal is a moving image composed of multiple display frames or a still image and driving so as to, when the determining means has determined that the video signal is a moving image, produce a partially charged display frame.

14. A display, comprising:

scan signal lines;

data signal lines fed with a video signal as a data signal;

a display section in which pixels are arranged to form a matrix, the pixels being connected via switching sections correspondingly to intersections of the scan signal lines and the data signal lines;

storage means storing video signal data for at least one display frame in a video signal composed of multiple display frames;

second drive means (i) causing n outputs of the video signal data for one display frame stored in the storage means at n-times speed (n is an integer greater than or equal to 2) in one vertical period and (ii) driving in at least one of the n n-time speed display frames so as to produce a partially charged display frame where a data signal fed to the data signal lines contains a signal having a level less than a level represented by the video signal, wherein the signal having a level less than said level is associated with a signal level in a preceding display frame, and wherein the second drive means controls a timing for a latch signal to shift an output timing to the data signal lines.

15. A display, comprising:

scan signal lines;

data signal lines fed with a video signal as a data signal;

a display section in which pixels are arranged to form a matrix, the pixels being connected via switching sections correspondingly to intersections of the scan signal lines and the data signal lines;

storage means storing video signal data for at least one display frame in a video signal composed of multiple display frames;

second drive means (i) causing n outputs of the video signal data for one display frame stored in the storage means at n-times speed (n is an integer greater than or equal to 2) in one vertical period and (ii) driving in at least one of the n n-time speed display frames so as to produce a partially charged display frame where a data signal fed to the data signal lines contains a signal having a level less than a level represented by the video signal, wherein the signal having a level less than said level is associated with a signal level in a preceding display frame, and wherein the second drive means controls a timing for a latch signal for every n-times speed display frame to shift an output timing to the data signal lines.

16. A display, comprising:

scan signal lines;

data signal lines fed with a video signal as a data signal;

a display section in which pixels are arranged to form a matrix, the pixels being connected via switching sections correspondingly to intersections of the scan signal lines and the data signal lines;

storage means storing video signal data for at least one display frame in a video signal composed of multiple display frames;

second drive means (i) causing n outputs of the video signal data for one display frame stored in the storage means at n-times speed (n is an integer greater than or equal to 2) in one vertical period and (ii) driving in at least one of the n n-time speed display frames so as to produce a partially charged display frame where a data signal fed to the data signal lines contains a signal having a level less than a level represented by the video signal, wherein the signal having a level less than said level is associated with a signal level in a preceding display frame, wherein the second drive means drives, with respect to an n-time speed display frame immediately before the partially charged display frame, so as to produce a fully charged display frame where a signal output level to the data signal lines is greater than, or equal to, the level represented by the video signal, and wherein the second drive means switches a signal polarity to the data signal lines for each pair of display frames, the pair being composed of the fully charged display frame and the successive partially charged display frame.

17. A display, comprising:

scan signal lines;

data signal lines fed with a video signal as a data signal;

a display section in which pixels are arranged to form a matrix, the pixels being connected via switching sections correspondingly to intersections of the scan signal lines and the data signal lines;

storage means storing video signal data for at least one display frame in a video signal composed of multiple display frames;

second drive means (i) causing n outputs of the video signal data for one display frame stored in the storage means at n-times speed (n is an integer greater than or equal to 2) in one vertical period and (ii) driving in at least one of the n n-time speed display frames so as to produce a partially charged display frame where a data signal fed to the data signal lines contains a signal having a level less than a level represented by the video signal, wherein the signal having a level less than said level is associated with a signal level in a preceding display frame, wherein the second drive means drives, with respect to an n-time speed display frame immediately before the partially charged display frame, so as to produce a fully charged display frame where a signal output level to the data signal lines is greater than, or equal to, the level represented by the video signal, and wherein the second drive means switches, at random, reversal of a signal output polarity to the data signal lines with respect to a position of a frame acting as a boundary between the fully charged display frame and the partially charged display frame, regardless of whether in the fully charged display frame or in the partially charged display frame.

18. A driver device for a display including: scan signal lines; data signal lines fed with a video signal as a data signal; and a display section in which pixels are arranged to form a matrix, the pixels being connected via switching sections correspondingly to intersections of the scan signal lines and the data signal lines, said driver device comprising first drive means, when displaying a video signal composed of multiple display frames, driving in at least one of the display frames so as to produce a partially charged display frame where a data signal fed to the data signal lines contains a signal having a level less than a level represented by the video signal, wherein the signal having a level less than said level is associated with a signal level in a preceding display frame, and either a pattern of a fully charged display frame immediately followed by a partially charged display frame is periodically repeated, or a pattern of plural, successive fully charged display frames and a single partially charged display frame is periodically repeated.

19. A driver device for a display including: scan signal lines; data signal lines fed with a video signal as a data signal; and a display section in which pixels are arranged to form a matrix, the pixels being connected via switching sections correspondingly to intersections of the scan signal lines and the data signal lines, said driver device comprising:

storage means storing video signal data for at least one display frame in a video signal composed of multiple display frames;

second drive means (i) causing n outputs of the video signal data for one display frame stored in the storage means at n-times speed (n is an integer greater than or equal to 2) in one vertical period and (ii) driving in at least one of the n n-time speed display frames so as to produce a partially charged display frame where a data signal fed to the data signal lines contains a signal having a level less than a level represented by the video signal, wherein the signal having a level less than said level is associated with a signal level in a preceding display frame, and either a pattern of a fully charged display frame immediately followed by a partially charged display frame is periodically repeated, or a pattern of plural, successive fully charged display frames and a single partially charged display frame is periodically repeated.

20. A display method for a display including: scan signal lines; data signal lines fed with a video signal as a data signal; and a display section in which pixels are arranged to form a matrix, the pixels being connected via switching sections correspondingly to intersections of the scan signal lines and the data signal lines, said method comprising, when displaying a video signal composed of multiple display frames, displaying in at least one of the display frames so as to produce a partially charged display frame where a data signal fed to the data signal lines contains a signal having a level less than a level represented by the video signal, wherein, the signal having a level less than said level is associated with a signal level in a preceding display frame, and either a pattern of a fully charged display frame immediately followed by a partially charged display frame is periodically repeated, or a pattern of plural, successive fully charged display frames and a single partially charged display frame is periodically repeated.

21. The display method as set forth in claim 20, further comprising:

determining whether the video signal is a moving image composed of multiple display frames or a still image and displaying so as to, when the determining means has determined that the video signal is a moving image, produce a partially charged display frame.

22. A display method for a display including: scan signal lines; data signal lines fed with a video signal as a data signal; and a display section in which pixels are arranged to form a matrix, the pixels being connected via switching sections correspondingly to intersections of the scan signal lines and the data signal lines, said method comprising:

storing video signal data for at least one display frame in a video signal composed of multiple display frames;

causing n outputs of the stored video signal data for one display frame at n-times speed (n is an integer greater than or equal to 2) in one vertical period and displaying in at least one of the n n-time speed display frames so as to produce a partially charged display frame where a data signal fed to the data signal lines contains a signal having a level less than a level represented by the video signal, wherein, the signal having a level less than said level is associated with a signal level in a preceding display frame, and either a pattern of a fully charged display frame immediately followed by a partially charged display frame is periodically repeated, or a pattern of plural, successive fully charged display frames and a single partially charged display frame is periodically repeated.

23. A display, comprising:

scan signal lines receiving scan signals:

data signal lines fed with a video signal as a data signal;

a display section in which pixels are arranged to form a matrix, the pixels being connected via switching sections correspondingly to intersections of the scan signal lines and the data signal lines; and third drive means, when displaying a video signal composed of multiple display frames, driving, in at least one of the display frames, a mixture of a fully charged display where a data signal fed to the data signal lines represents the video signal and a partially charged display where the data signal fed to the data signal lines contains a signal having a level less than a level represented by the video signal, produced by shifting an output timing between said scan signals and latch pulses controlling timings of data signals to the data signal lines, wherein the signal having a level less than said level is associated with a signal level in a preceding display frame.

24. The display as set forth in claim 23, wherein the third drive means includes output timing switching means switching for each scan signal line or each set of scan signal lines in one display frame between an output timing at which a fully charged display represented by the video signal to the pixels is produced and an output timing at which the partially charged display is produced.

25. A driver device for a display including: scan signal lines receiving scan signals; data signal lines fed with a video signal as a data signal; and a display section in which pixels are arranged to form a matrix, the pixels being connected via switching sections correspondingly to intersections of the scan signal lines and the data signal lines, said driver device comprising third drive means, when displaying a video signal composed of multiple display frames, driving, in at least one of the display frames, a mixture of a fully charged display where a data signal fed to the data signal lines represents the video signal and a partially charged display where the data signal fed to the data signal lines contains a signal having a level less than a level represented by the video signal, produced by shifting an output timing between said scan signals and latch pulses controlling timings of data signals to the data signal lines, wherein the signal having a level less than said level is associated with a signal level in a preceding display frame.

26. The display as set forth in claim 25, wherein the third drive means includes output timing switching means switching for each scan signal line or each set of scan signal lines in one display frame between an output timing at which a fully charged display represented by the video signal to the pixels is produced and an output timing at which the partially charged display is produced.

27. A display method for a display including: scan signal lines receiving scan signals; data signal lines fed with a video signal as a data signal; and a display section in which pixels are arranged to form a matrix, the pixels being connected via switching sections correspondingly to intersections of the scan signal lines and the data signal lines, said method comprising, when displaying a video signal composed of multiple display frames, driving, in at least one of the display frames, a mixture of a fully charged display where a data signal fed to the data signal lines represents the video signal and a partially charged display where the data signal fed to the data signal lines contains a signal having a level less than a level represented by the video signal, produced by shifting an output timing between said scan signals and latch pulses controlling timings of data signals to the data signal lines, wherein, the signal having a level less than said level is associated with a signal level in a preceding display frame.

28. The display method as set forth in claim 27, further comprising:

switching for each scan signal line or each set of scan signal lines in one display frame between an output timing at which a fully charged display represented by the video signal to the pixels is produced and an output timing at which the partially charged display is produced.

* * * * *